US010444695B2

(12) United States Patent
Ishida et al.

(10) Patent No.: US 10,444,695 B2
(45) Date of Patent: Oct. 15, 2019

(54) HOUSING, ELECTRONIC DEVICE WITH HOUSING, AND IMAGE FORMING APPARATUS WITH ELECTRONIC DEVICE

(71) Applicants: Masahiro Ishida, Kanagawa (JP); Naoki Matsuda, Kanagawa (JP); Keisuke Shimizu, Tokyo (JP); Kohta Takenaka, Kanagawa (JP)

(72) Inventors: Masahiro Ishida, Kanagawa (JP); Naoki Matsuda, Kanagawa (JP); Keisuke Shimizu, Tokyo (JP); Kohta Takenaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/414,928

(22) Filed: Jan. 25, 2017

(65) Prior Publication Data

US 2017/0219990 A1 Aug. 3, 2017

(30) Foreign Application Priority Data

Jan. 29, 2016 (JP) ..... 2016-016138
Jan. 29, 2016 (JP) ..... 2016-016153

(51) Int. Cl.
*G03G 21/16* (2006.01)

(52) U.S. Cl.
CPC . *G03G 21/1633* (2013.01); *G03G 2215/0129* (2013.01)

(58) Field of Classification Search
CPC ..... G03G 21/1619; G03G 21/1633; G03G 2221/1678; G03G 2221/169; G10K 11/18
See application file for complete search history.

(56) References Cited

U.S. PATENT DOCUMENTS

| | | | | |
|---|---|---|---|---|
| 4,146,112 | A | 3/1979 | Usry | |
| 4,974,339 | A | 12/1990 | Kawamura et al. | |
| 2006/0185931 | A1 | 8/2006 | Kawar | |
| 2007/0059019 | A1 | 3/2007 | Kasama | |
| 2015/0248880 | A1* | 9/2015 | Matsuda | G03G 21/1619 399/107 |

(Continued)

FOREIGN PATENT DOCUMENTS

| | | |
|---|---|---|
| JP | 3-071688 | 7/1991 |
| JP | 6-153334 | 5/1994 |

(Continued)

*Primary Examiner* — Sevan A Aydin
(74) *Attorney, Agent, or Firm* — Harness, Dickey & Pierce, P.L.C.

(57) ABSTRACT

A housing includes at least one openable cover and at least one adjacent cover. The at least one openable cover swings on a hinge to separate an interior of the housing from an exterior of the housing. The at least one openable cover has a first side edge on a side of the hinge. The at least one adjacent cover is adjacent to the at least one openable cover. The at least one adjacent cover has a second side edge neighboring the first side edge of the at least one openable cover across a gap. One of the at least one openable cover and the at least one adjacent cover includes at least one projection projecting into the gap and another one of the at least one openable cover and the at least one adjacent cover includes a recess that accommodates the at least one projection in the gap.

19 Claims, 25 Drawing Sheets

(56) References Cited

U.S. PATENT DOCUMENTS

| | | | |
|---|---|---|---|
| 2016/0170361 | A1 | 6/2016 | Matsuda et al. |
| 2016/0170368 | A1 | 6/2016 | Ishida et al. |

FOREIGN PATENT DOCUMENTS

| | | | |
|---|---|---|---|
| JP | 10-019035 | | 1/1998 |
| JP | 2011-014625 | A | 1/2011 |
| JP | 2015-029639 | A | 2/2015 |
| JP | 2015-078058 | | 4/2015 |
| JP | 2015-181157 | | 10/2015 |
| JP | 2016-113244 | | 6/2016 |
| JP | 2016-114722 | | 6/2016 |

* cited by examiner

HOUSING, ELECTRONIC DEVICE WITH HOUSING, AND IMAGE FORMING APPARATUS WITH ELECTRONIC DEVICE

CROSS-REFERENCE TO RELATED APPLICATIONS

This patent application is based on and claims priority pursuant to 35 U.S.C. § 119(a) to Japanese Patent Application Nos. 2016-016138 and 2016-016153, both filed on Jan. 29, 2016 in the Japan Patent Office, the entire disclosures of which are hereby incorporated by reference herein.

BACKGROUND

Technical Field

Embodiments of the present disclosure relate to a housing, an electronic device with the housing, and an image forming apparatus with the electronic device.

Related Art

An electrophotographic image forming apparatus generally includes an exterior cover that covers multiple image forming units installed therein. Thus, the exterior cover partitions the image forming apparatus into an interior and an exterior of the image forming apparatus.

Such an image forming apparatus provides an exterior cover to swing on a hinge to open and close a housing to suppress transmission of sound from the image forming apparatus and accordingly reduce noise therefrom.

SUMMARY

One aspect of the present disclosure provides a housing that includes at least one openable cover and at least one adjacent cover. The at least one openable cover swings on a hinge to separate an interior of the housing from an exterior of the housing. The at least one openable cover has a first side edge on a side of the hinge. The at least one adjacent cover is adjacent to the at least one openable cover. The at least one adjacent cover has a second side edge neighboring the first side edge of the at least one openable cover across a gap. One of the at least one openable cover and the at least one adjacent cover includes at least one projection projecting into the gap and another one of the at least one openable cover and the at least one adjacent cover includes a recess that accommodates the at least one projection in the gap.

Another aspect of the present disclosure provides an electronic device that includes a sound source and the housing. The sound source generates sound during operation of the electronic device. The housing covers the sound source.

Still another aspect of the present disclosure provides an image forming apparatus that includes the electronic device.

Still yet another aspect of the present disclosure provides a housing that includes at least one openable cover, at least one adjacent cover, and an air passage. The at least one openable cover swings on a hinge to separate an interior of the housing from an exterior of the housing. The at least one openable cover has a first side edge on a side of the hinge. The at least one adjacent cover is adjacent to the at least one openable cover. The at least one adjacent cover has a second side edge neighboring the first side edge of the openable cover across a gap. The air passage extends from the interior of the housing to the exterior of the housing through the gap. The air passage includes at least two deflecting portions in the gap to deflect sound generated inside the housing.

Still yet another aspect of the present disclosure provides a housing that includes at least one openable cover, at least one adjacent cover, at least one openable cover projection, and an air passage. The at least one openable cover swings on a hinge to separate an interior of the housing from an exterior of the housing. The at least one openable cover has a first side edge on a side of the hinge. The at least one adjacent cover is adjacent to the at least one openable cover. The at least one adjacent cover has a second side edge neighboring the first side edge of the openable cover across a gap. The at least one openable cover projection projects from the at least one openable cover to the at least one adjacent cover in the gap. The air passage is extended from the interior of the housing to the exterior of the housing through the gap. The at least one openable cover projection constitutes a deflecting section having at least two deflecting portions in the gap. The at least one openable cover projection separates from the at least one adjacent cover when the at least one openable cover swings from a closed state to an opened state.

Still yet another aspect of the present disclosure provides a housing that includes at least one openable cover, at least one adjacent cover, at least one openable cover projection, and at least one opposing projection. The at least one openable cover swings on a hinge to separate an interior of the housing from an exterior of the housing. The at least one openable cover includes a first side edge on a side of the hinge. The at least one adjacent cover separates the interior of the housing from the exterior of the housing. The at least one adjacent cover has a second side edge neighboring the first side edge of the openable cover across a gap. The at least one openable cover projection projects from a position further inboard of the housing than the hinge into the at least one adjacent cover to form the gap between a tip side face of the at least one openable cover projection and the adjacent cover. The at least one opposing projection projects from the at least one adjacent cover in an opposite direction to a direction toward the at least one openable cover projection with a tip side face of the at least one opposing projection located closer to a base of the at least one openable cover projection than a tip of the at least one openable cover projection to form the gap between the tip side face of the at least one opposing projection and the at least one openable cover.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein.

Figure 1:
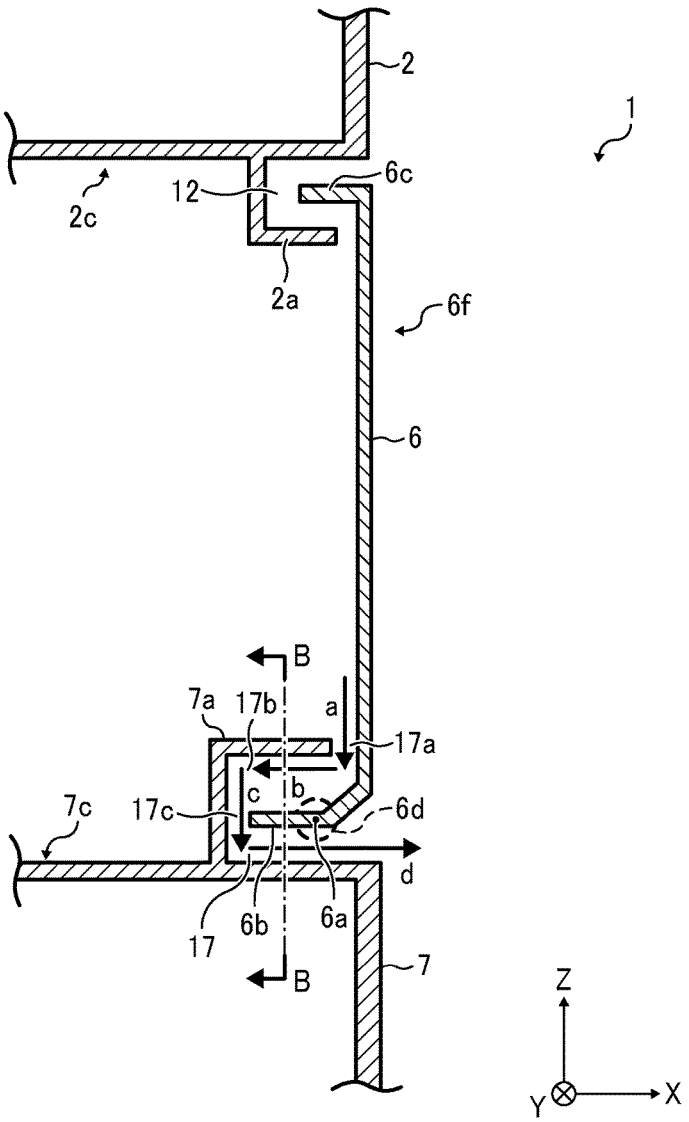
FIG. 1 is a cross-sectional view schematically illustrating an exemplary openable exterior cover to open and close a image forming apparatus and an fixed exterior cover according to a first embodiment of the present disclosure.
Figure 4:
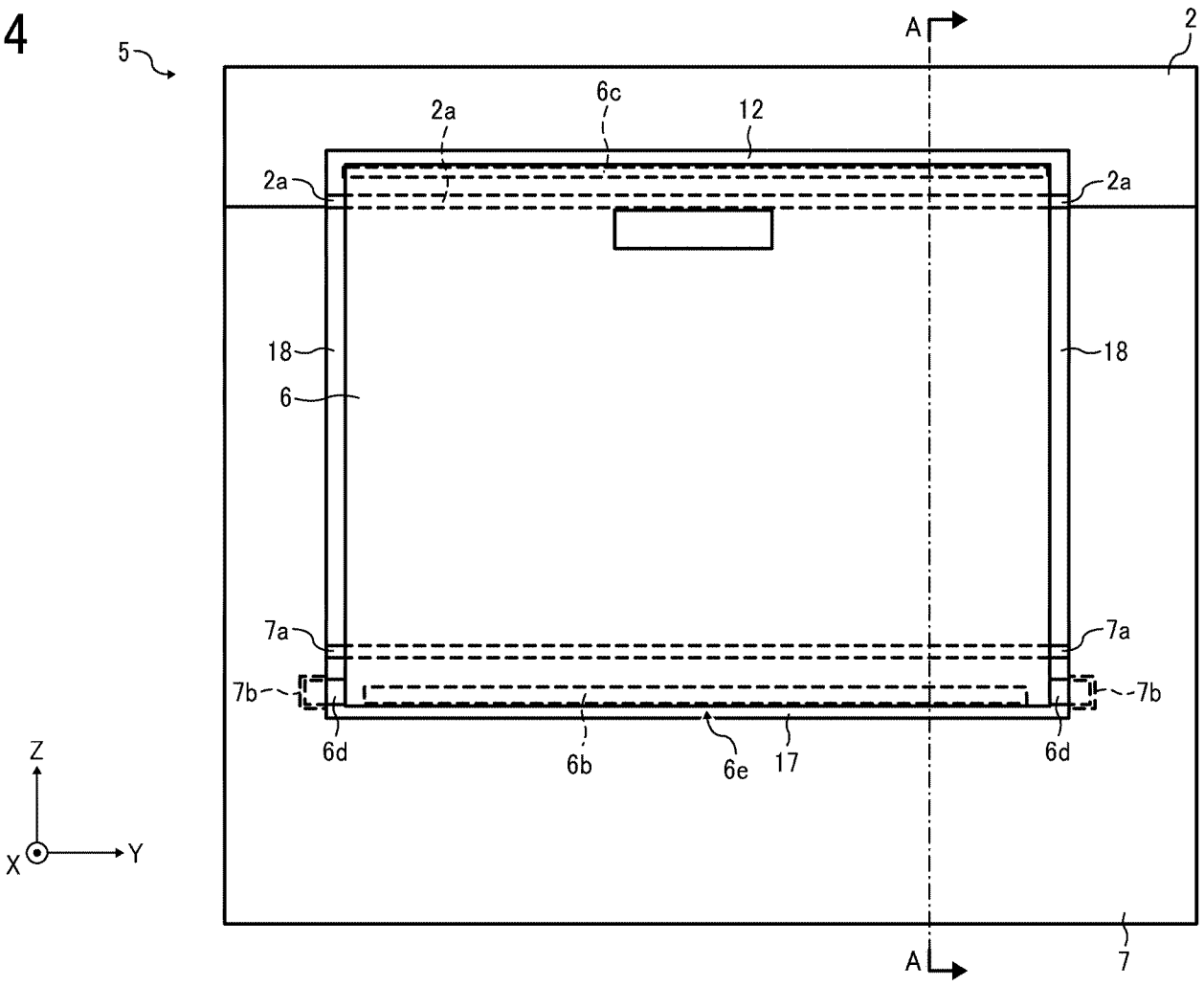
FIG. 4 is an enlarged view schematically illustrating the openable exterior cover taken from a right side of an image forming unit of the image forming apparatus shown in FIG.
Figure 5:
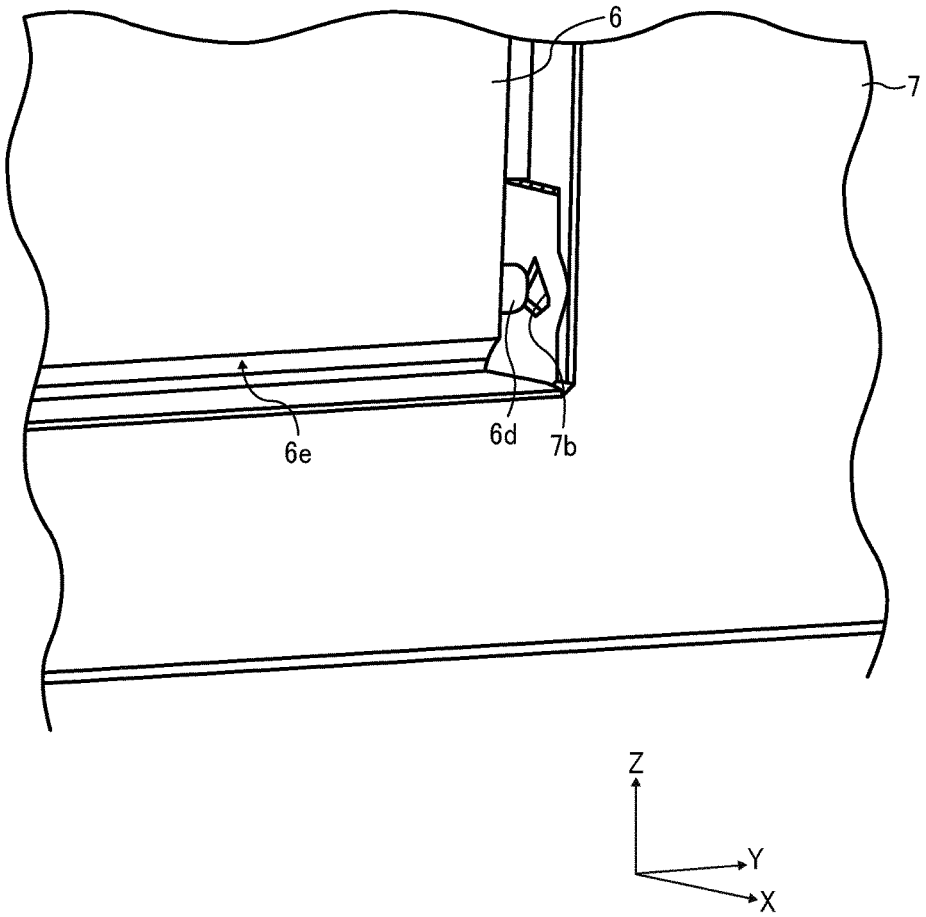
Figure 6:
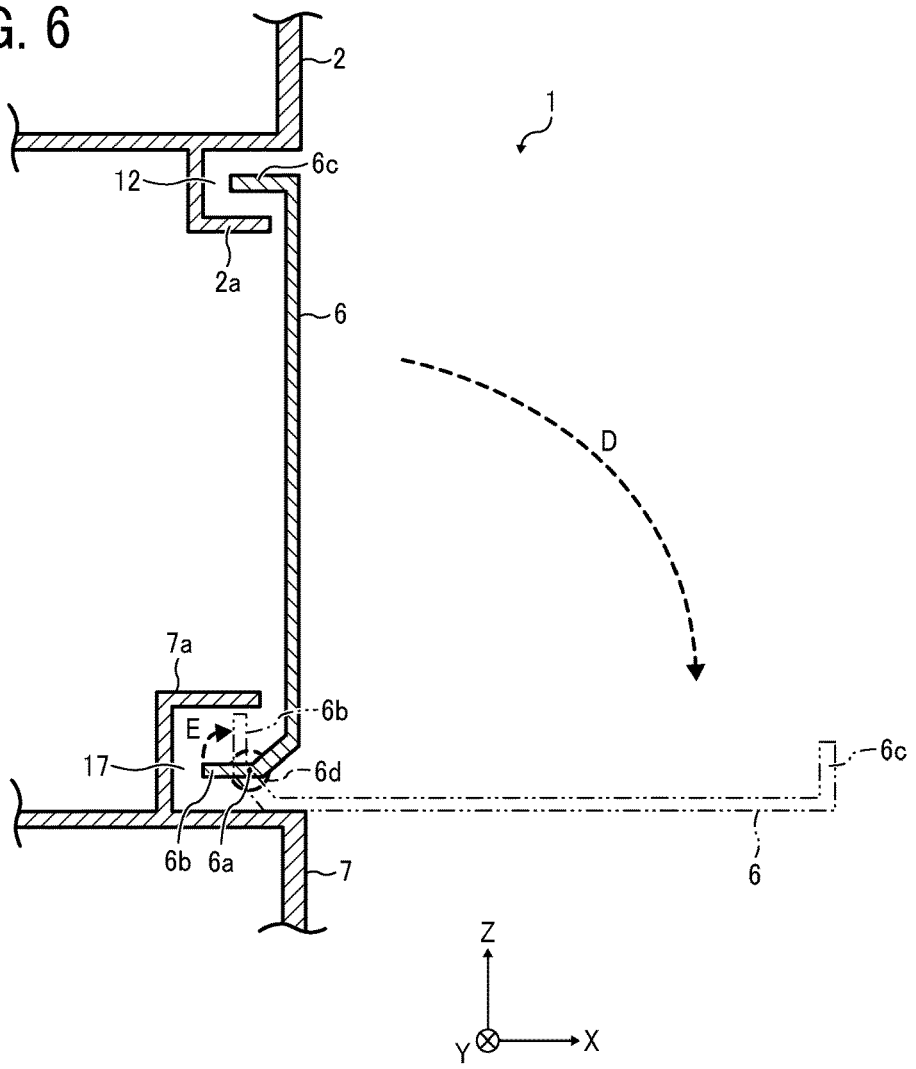
Figure 7:
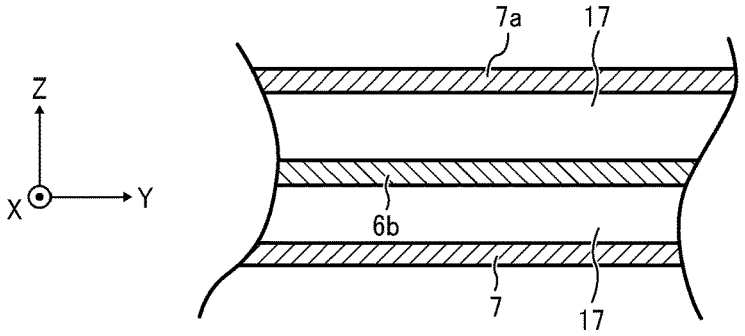
Figure 8A:
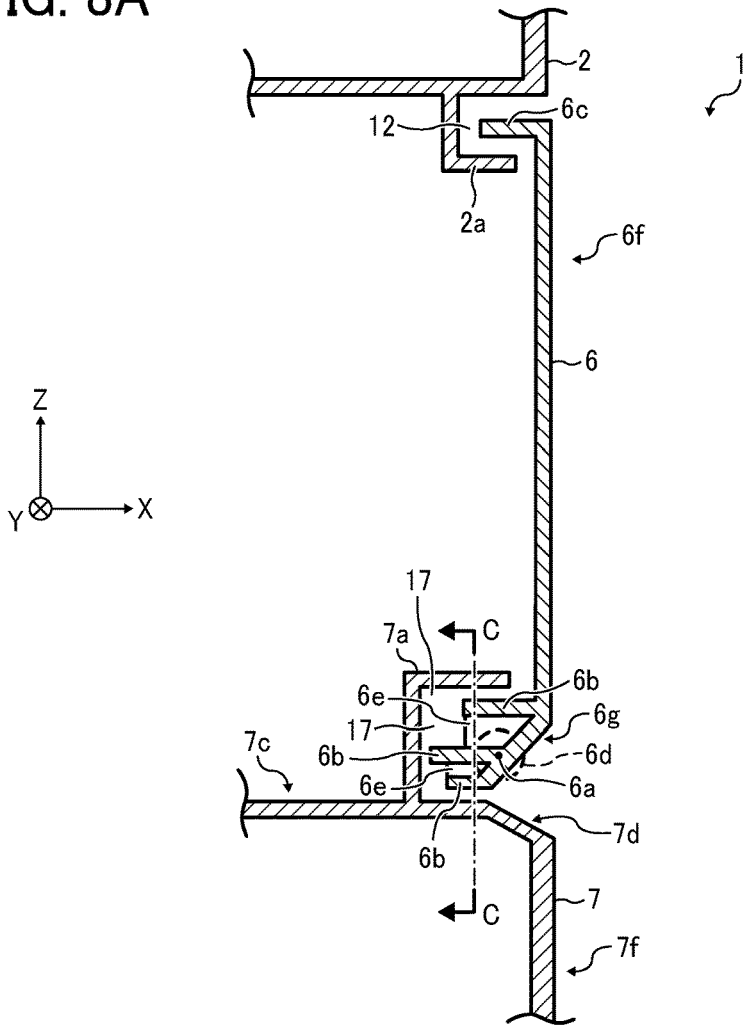
Figure 8B:
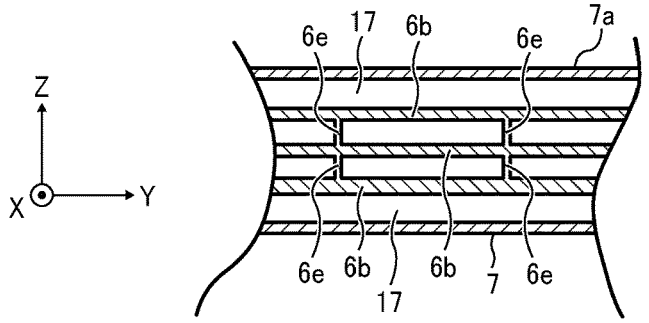
Figure 9:
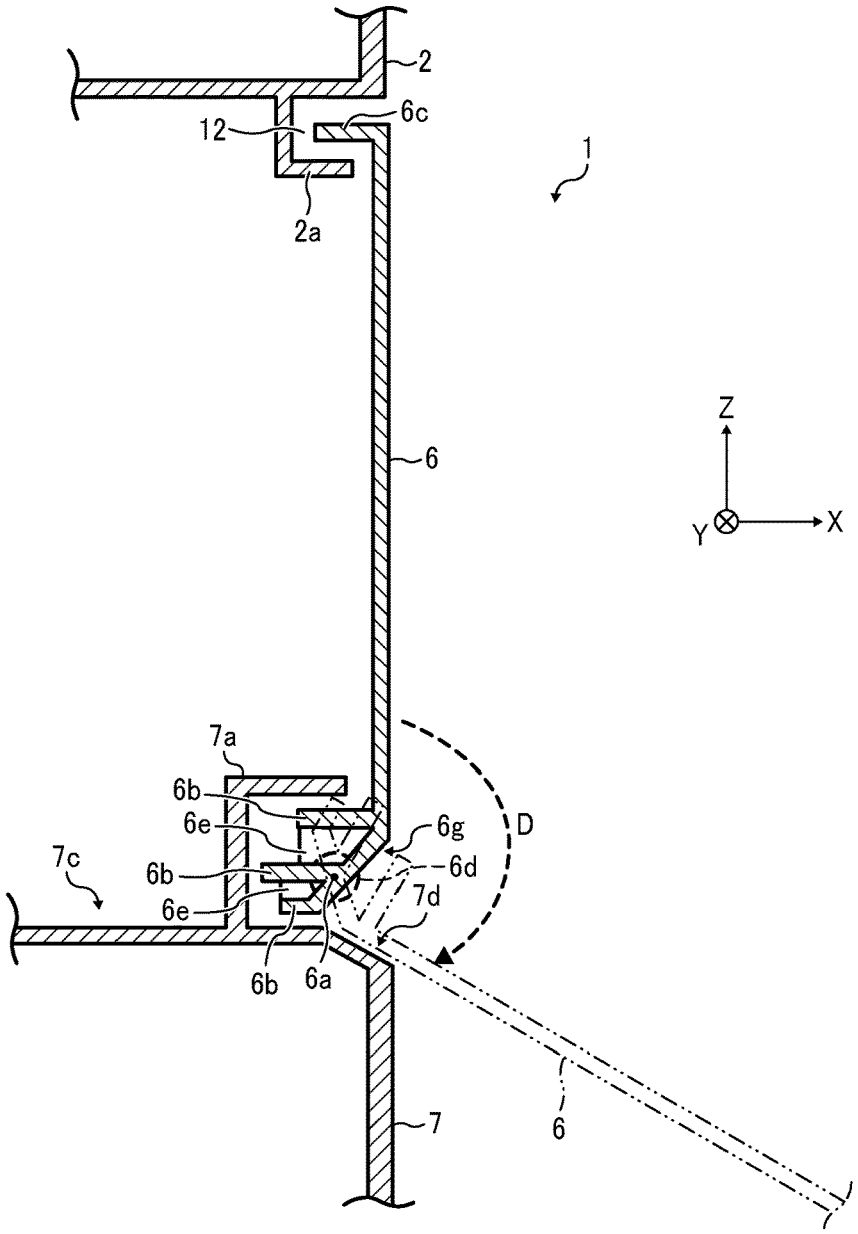
Figure 10:
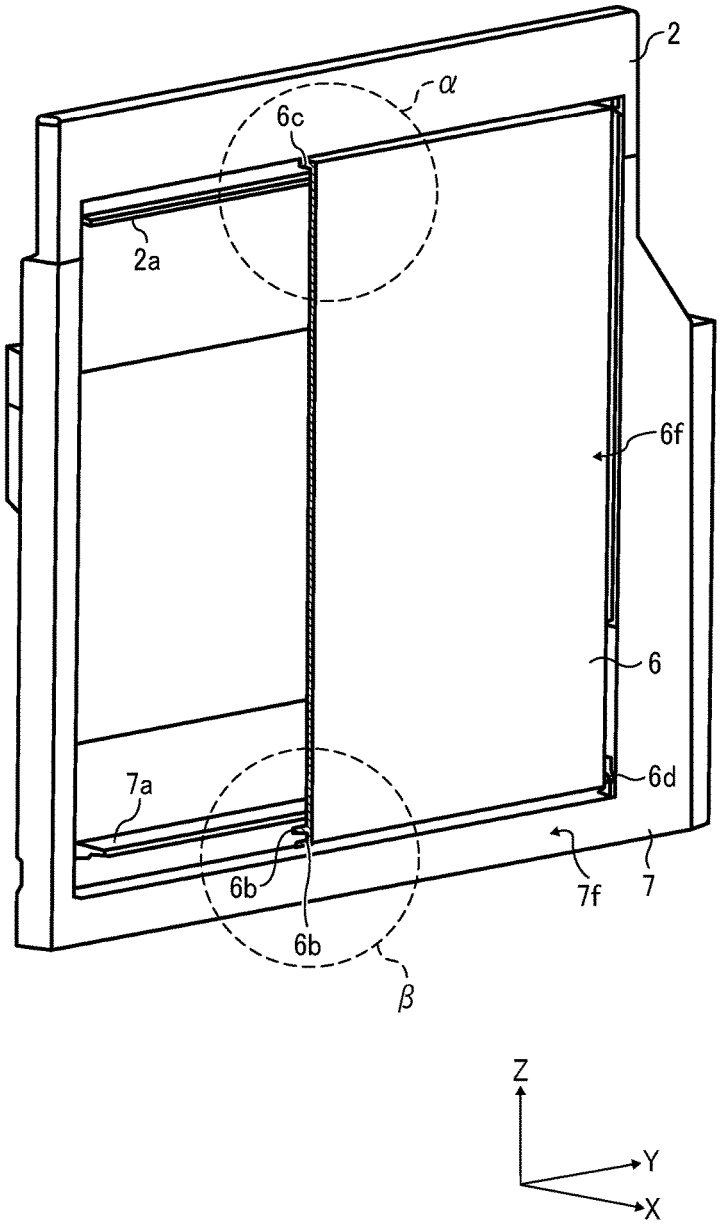
Figure 11A:
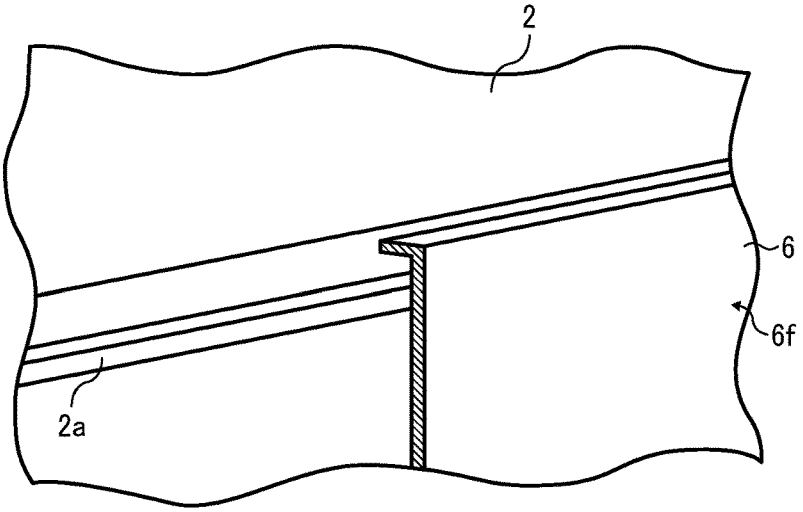
Figure 11B:
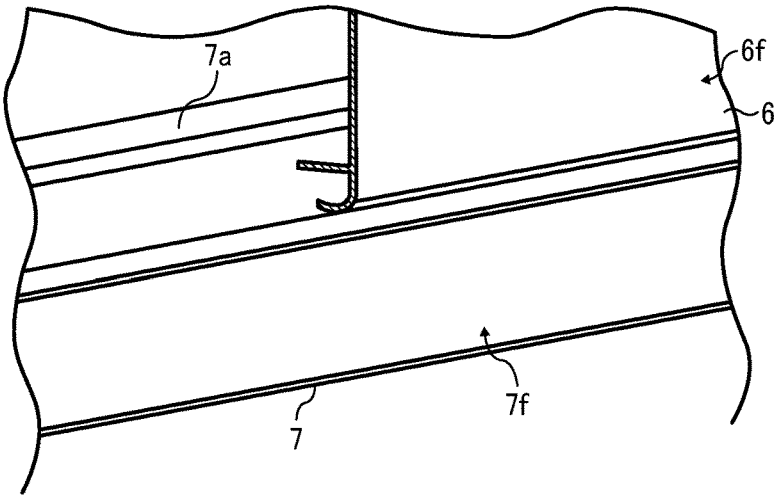
Figure 12:
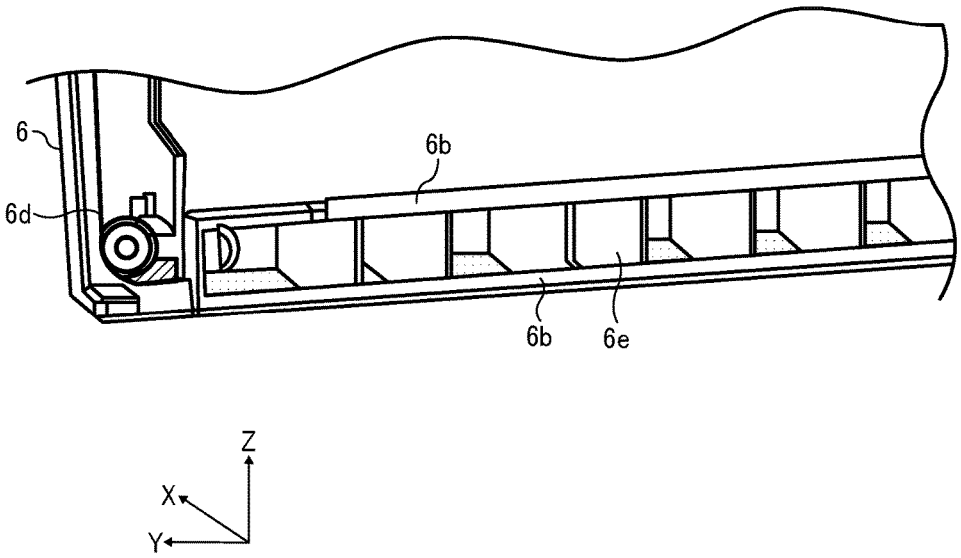
Figure 13:
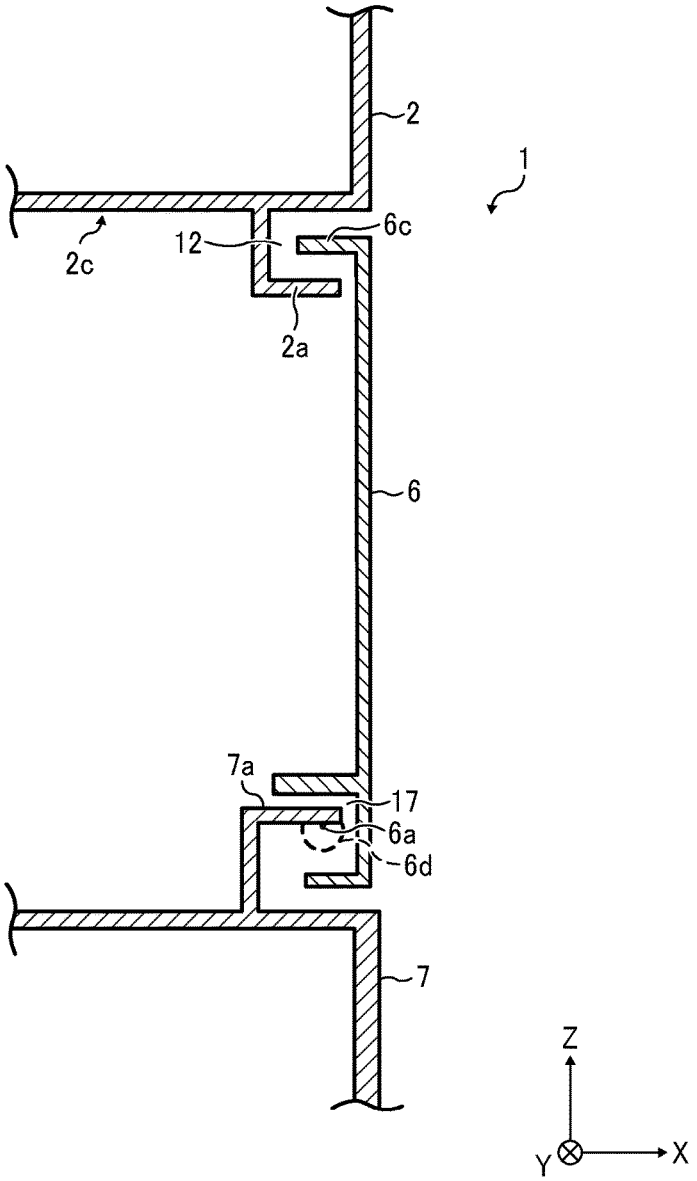
Figure 14:
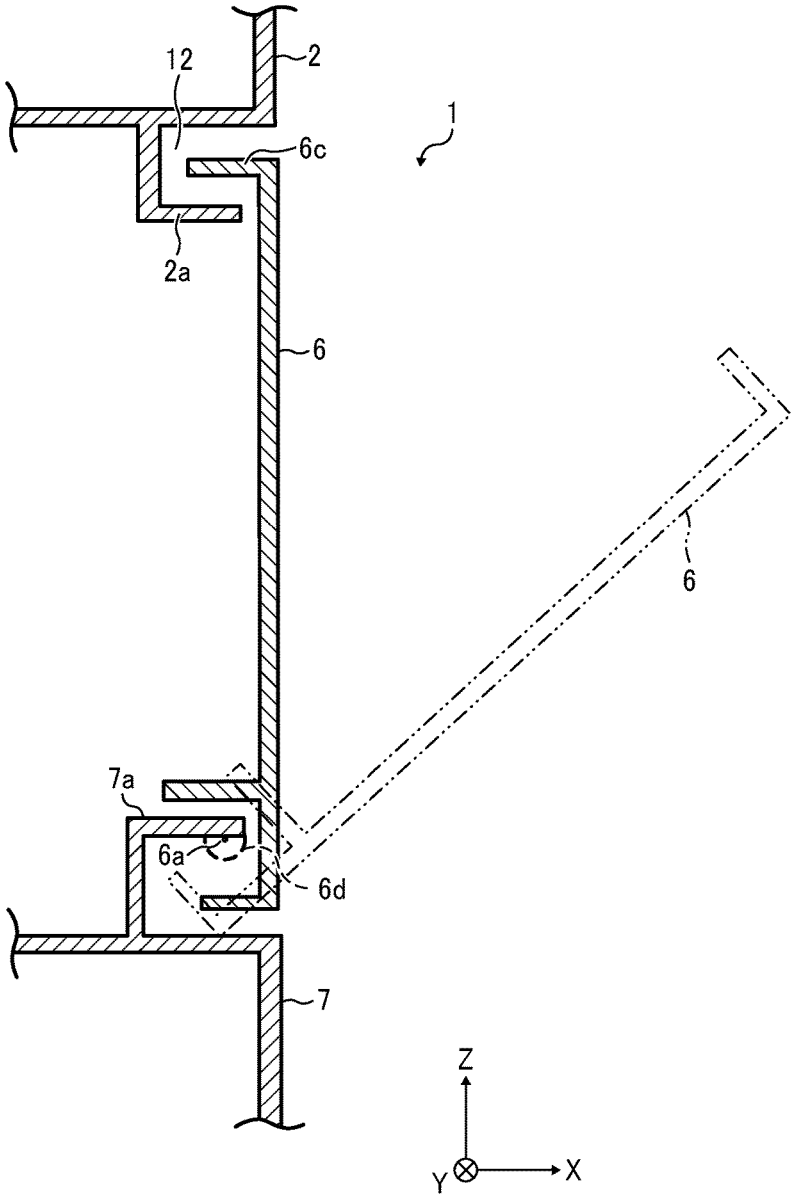
Figure 15:
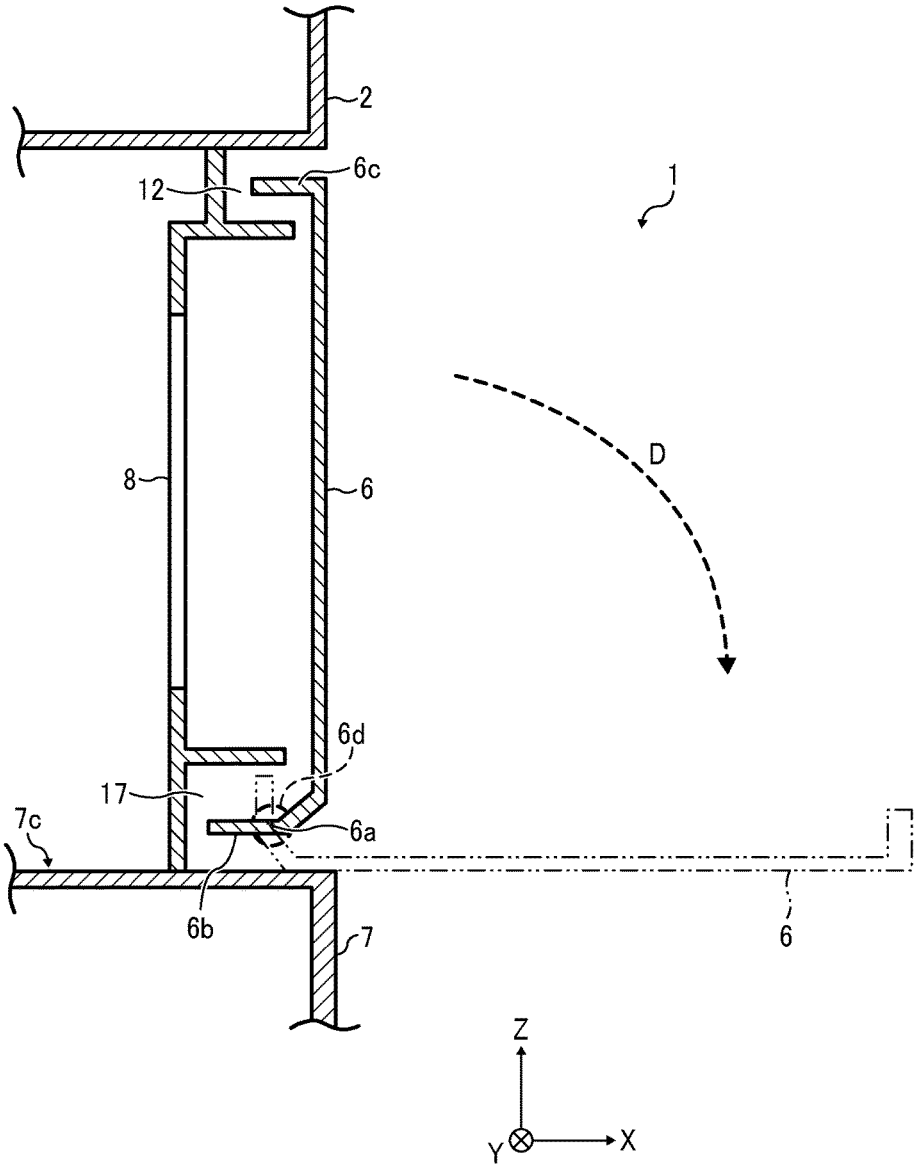
Figure 16:
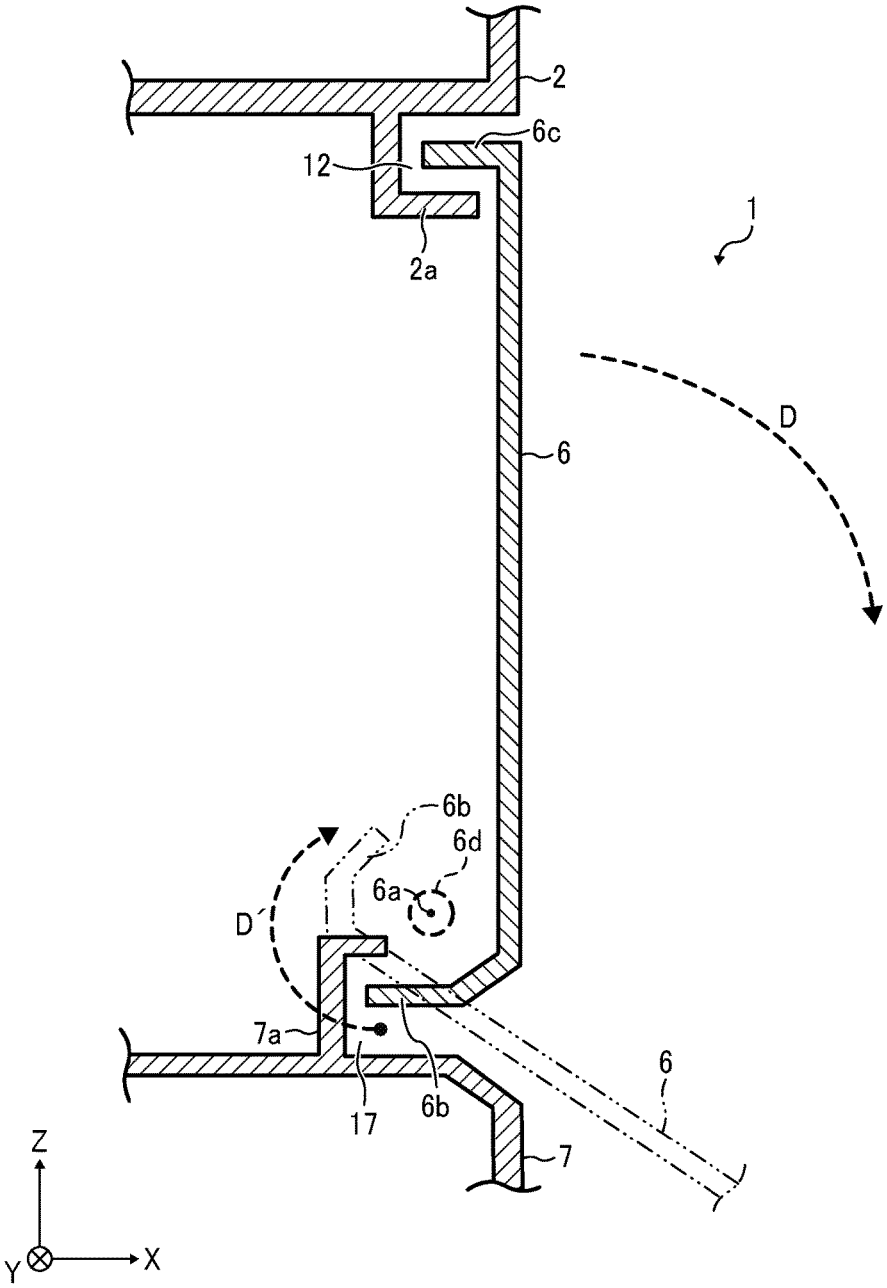
FIG. 16 RELATED ART
Figure 17:
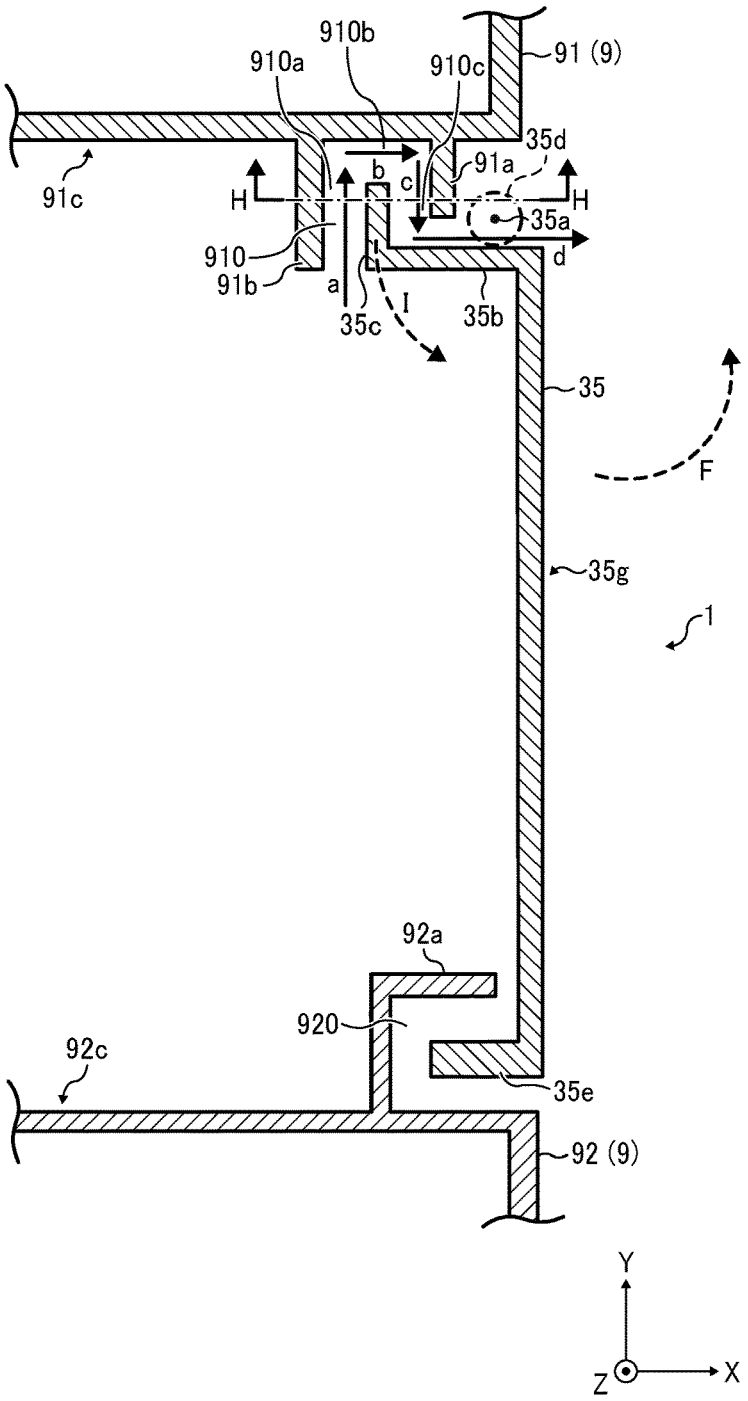
Figure 18:
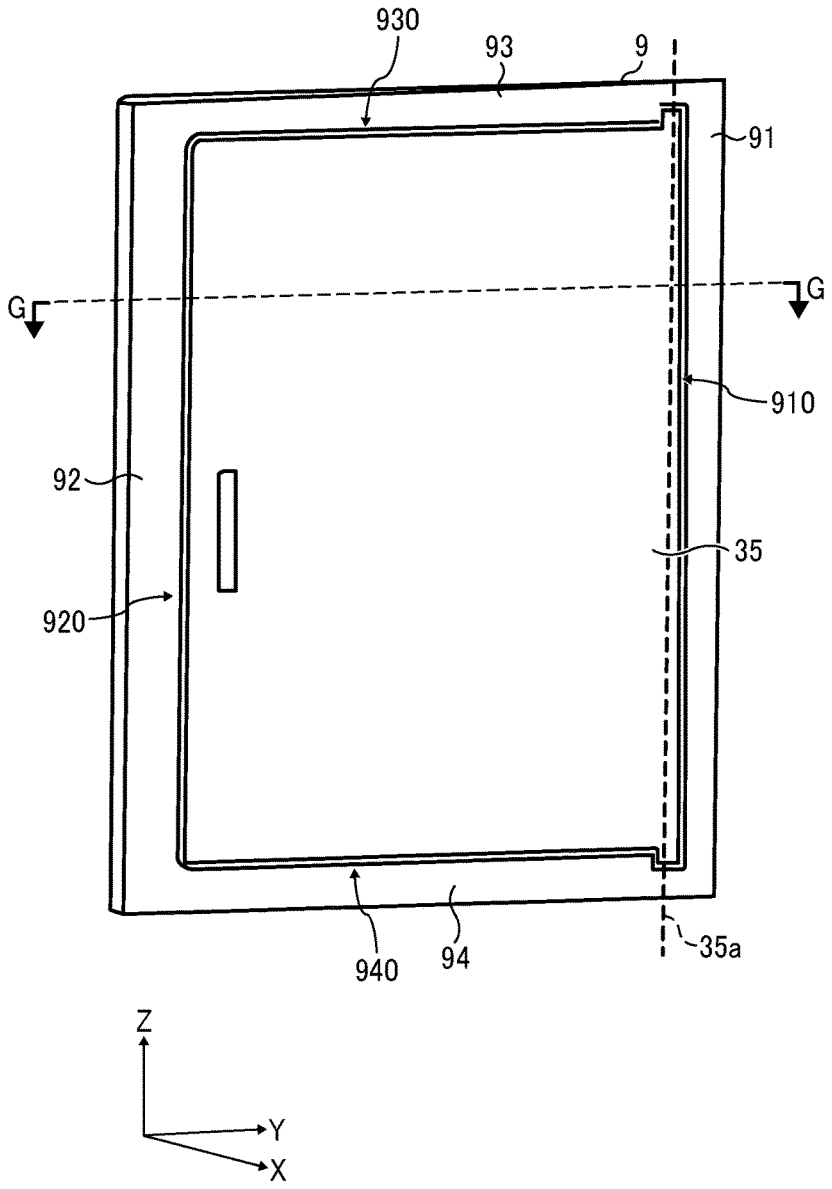
Figure 19:
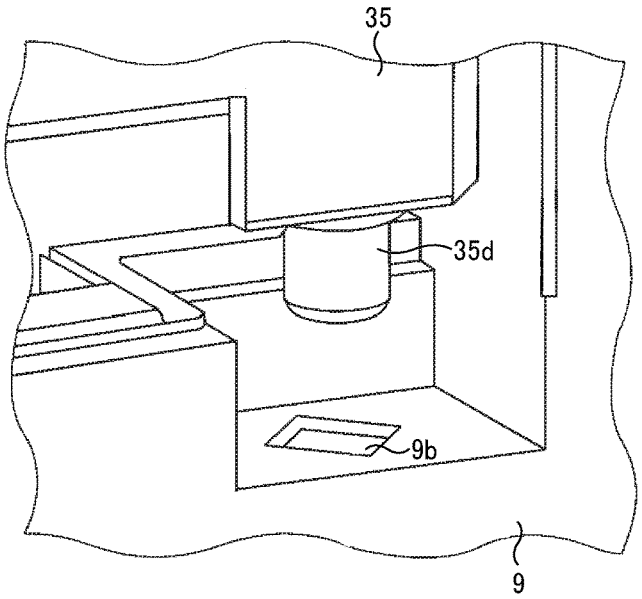
Figure 20:
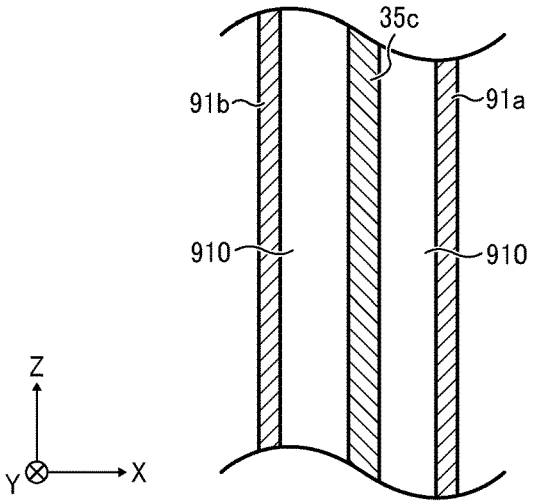
Figure 21:
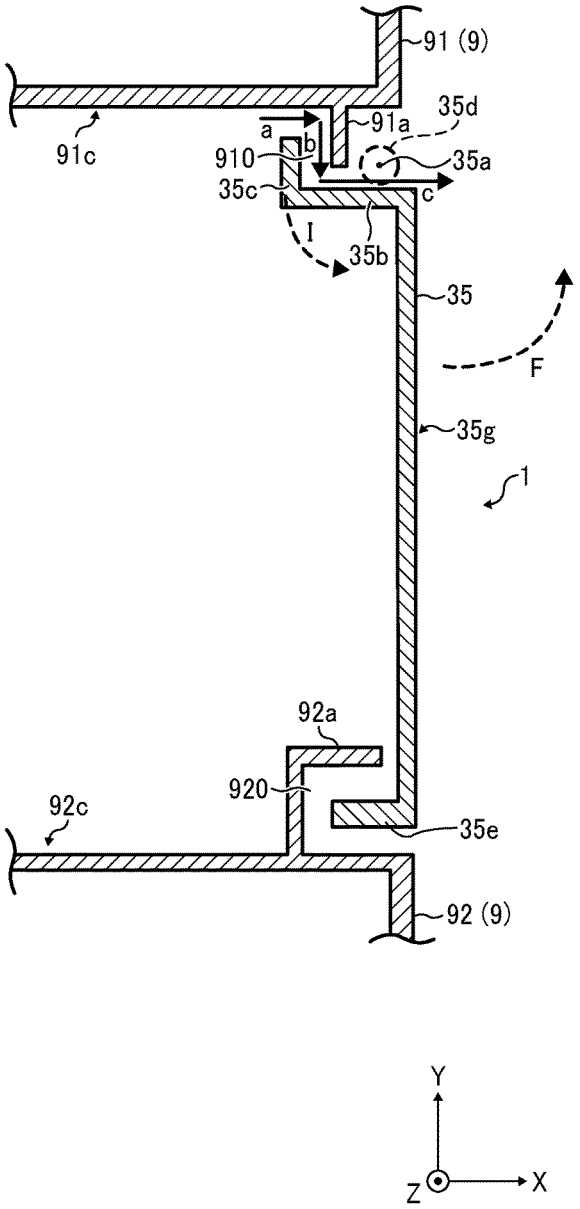
Figure 22A:
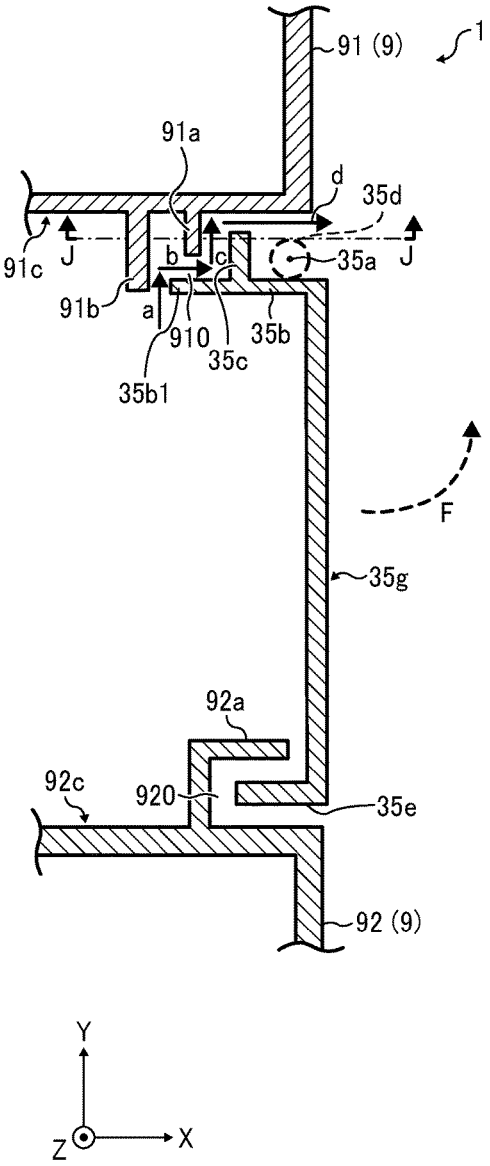
Figure 22B:
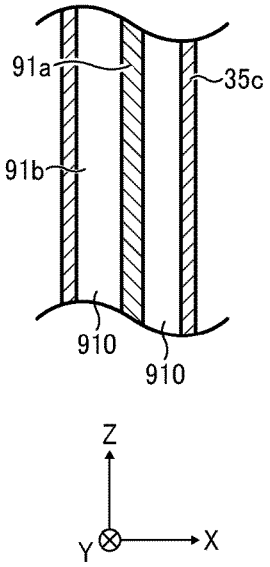
Figure 23:
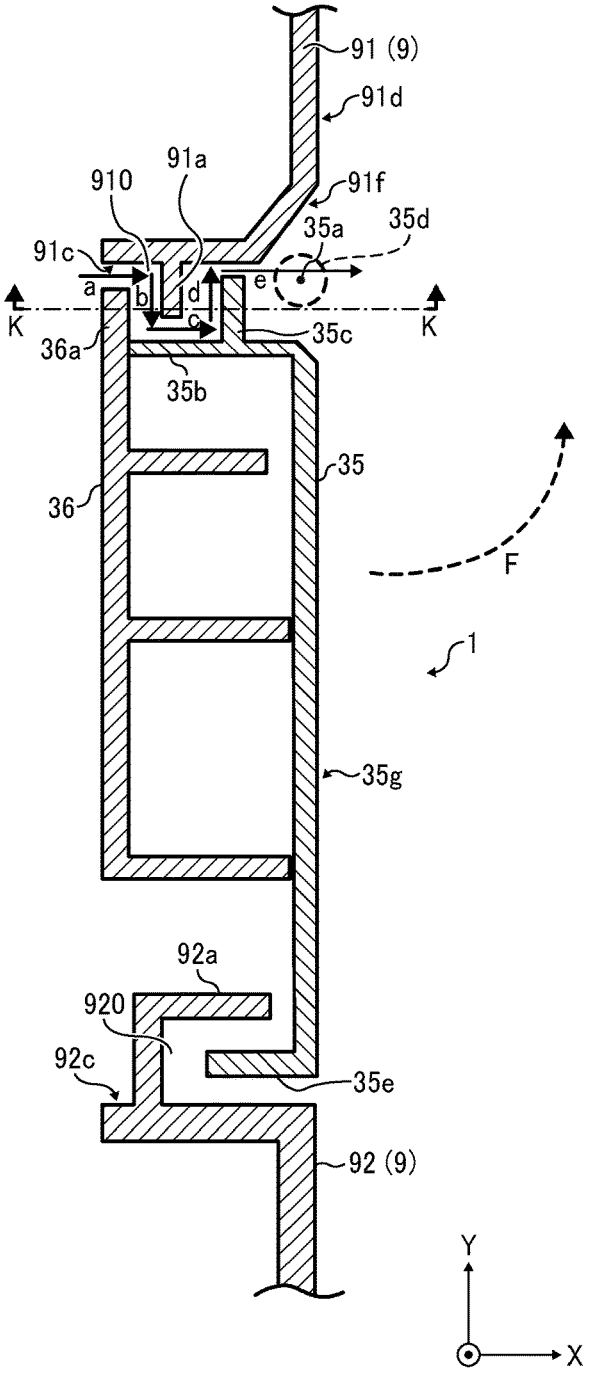
Figure 24:
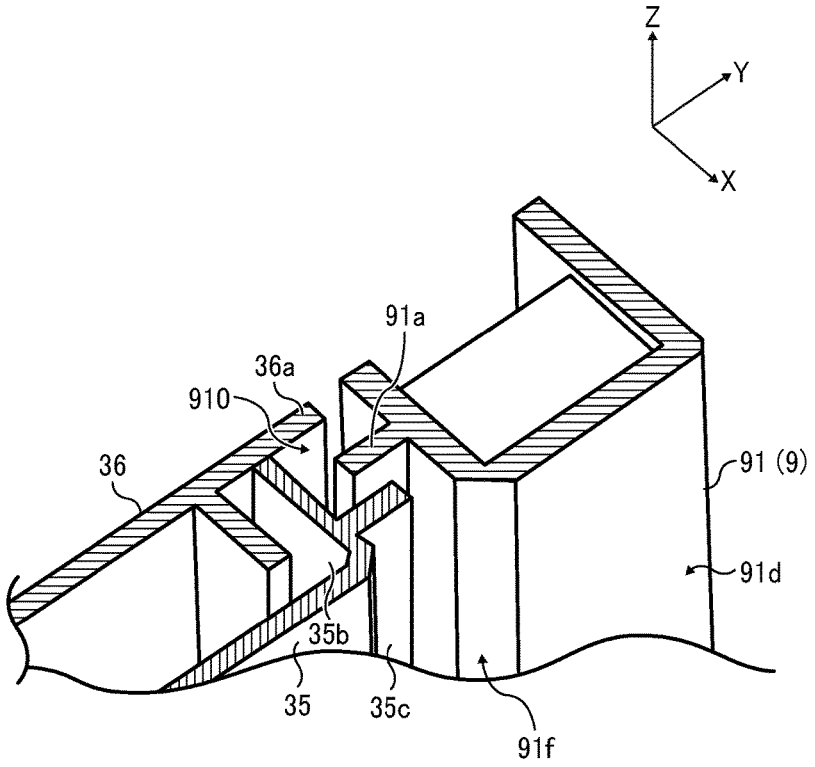
Figure 25A:
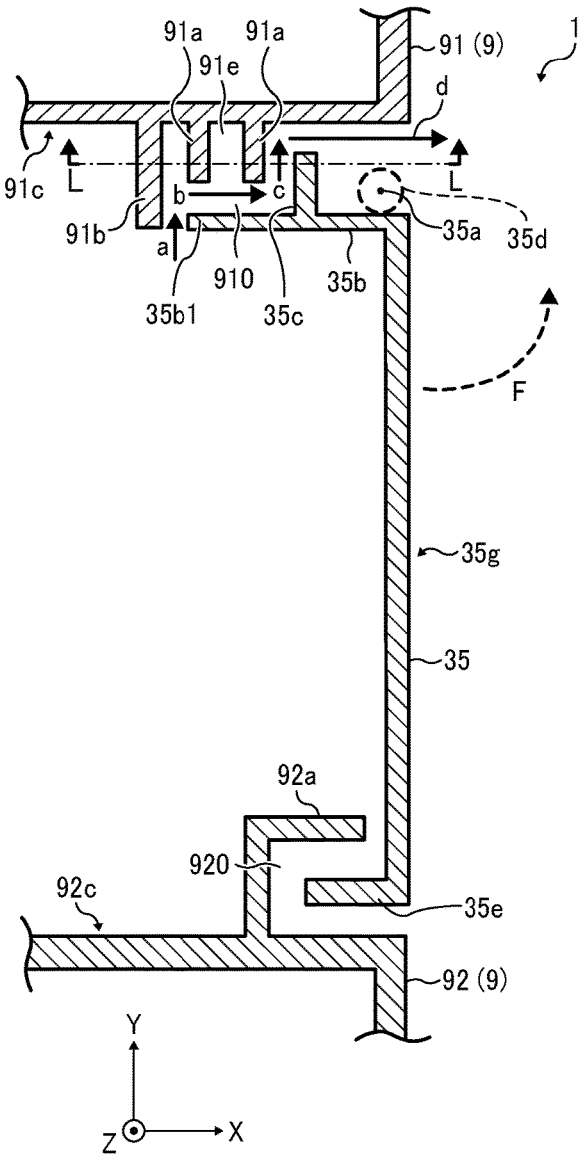
Figure 25B:
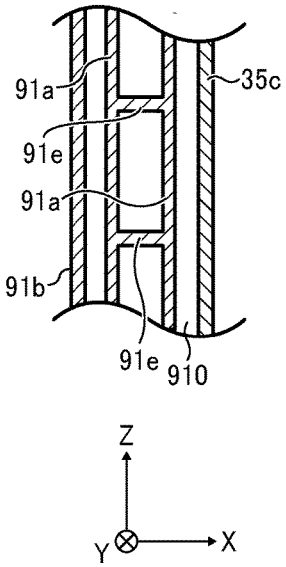
Figure 26:
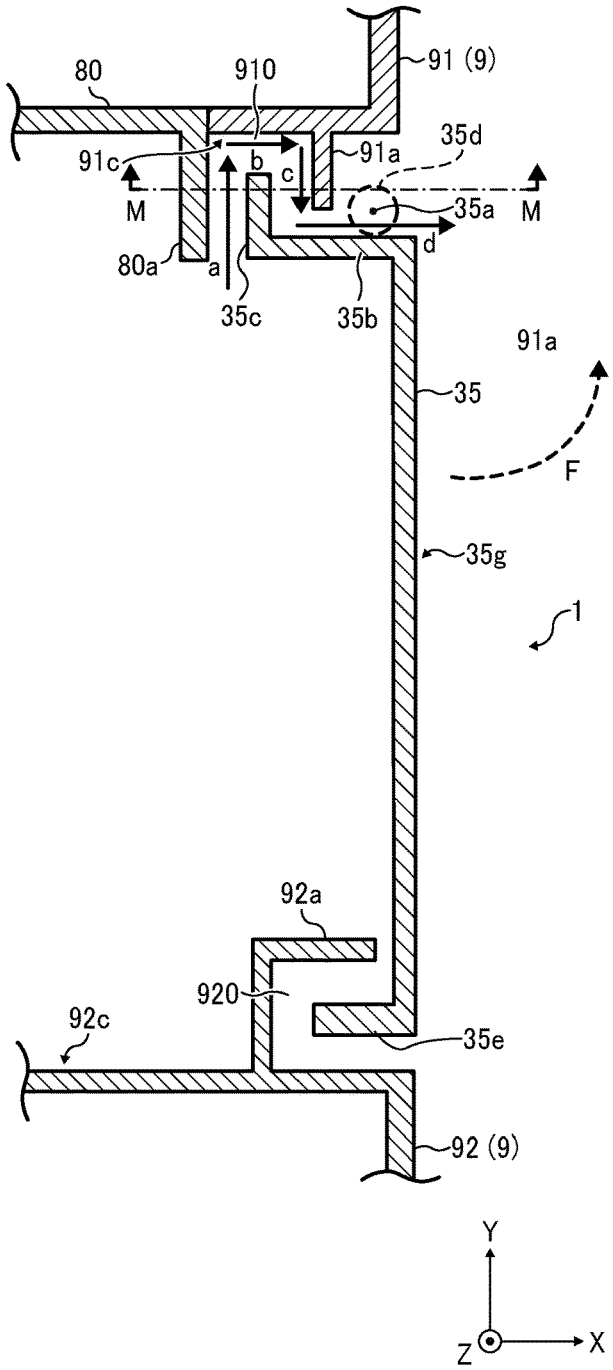
Figure 27:
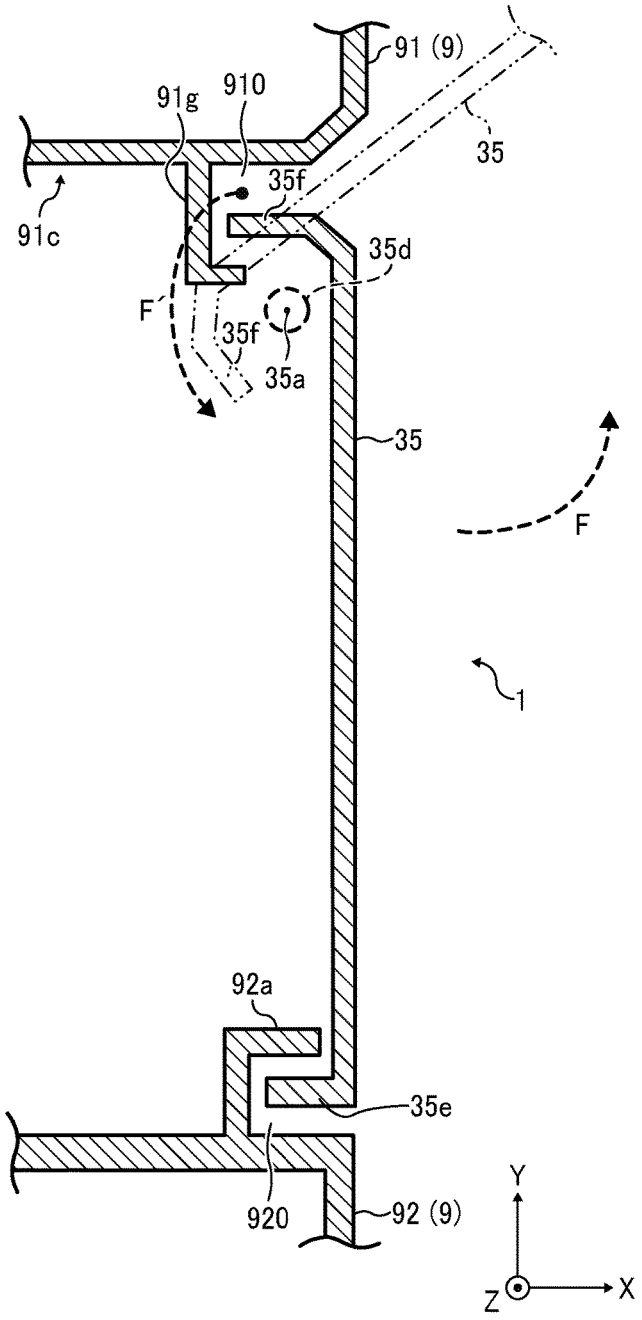
FIG. 27 RELATED ART

2 when the openable exterior cover is closed according to the first embodiment of the present disclosure;

FIG. 5 is an enlarged perspective view schematically illustrating a bottom right portion of the openable exterior cover shown in FIG. 4 and surroundings thereof according to the first embodiment of the present disclosure;

FIG. 6 is a cross-sectional view schematically illustrating an exemplary swinging locus of an exterior cover displayed when the exterior cover is opened according to the first embodiment of the present disclosure;

FIG. 7 is a cross-sectional view schematically illustrating the openable exterior cover and the fixed exterior cover when along the line B-B drawn in FIG. 1 according to the first embodiment of the present disclosure;

FIGS. 8A and 8B are diagrams collectively illustrating an exemplary openable exterior cover to open and close an apparatus and a fixed exterior cover according to a first modification of the first embodiment of the present disclosure;

FIG. 8A is a cross-sectional view schematically illustrating the openable exterior cover and the fixed exterior cover according to a first modification of the first embodiment of the present disclosure;

FIG. 8B also is a cross-sectional view schematically illustrating the openable exterior cover and the fixed exterior cover of FIG. 8A along the line C-C according to the first modification of the first embodiment of the present disclosure;

FIG. 9 is a cross-sectional view schematically illustrating an exemplary swinging locus of the exterior cover of FIG. 8A displayed when the exterior cover is opened according to the first modification of the first embodiment of the present disclosure;

FIG. 10 is a perspective view schematically illustrating the exterior cover and the fixed exterior cover of FIG. 8A according to the first modification of the first embodiment of the present disclosure;

FIGS. 11A and 11B are enlarged views collectively illustrating the exterior cover and the fixed exterior cover of FIG. 10 partially according to the first modification of the first embodiment of the present disclosure;

FIG. 11A is an enlarged view schematically illustrating a region indicated by $\alpha$ of the exterior cover and the fixed exterior cover of FIG. 10 according to the first modification of the first embodiment of the present disclosure;

FIG. 11B also is an enlarged view schematically illustrating a region indicated by $\beta$ of the exterior cover and the fixed exterior cover of FIG. 10 according to the first modification of the first embodiment of the present disclosure;

FIG. 12 is an enlarged perspective view schematically illustrating a projection hinge of the openable exterior cover and surroundings thereof according to the first modification of the first embodiment of the present disclosure;

FIG. 13 is a cross-sectional view schematically illustrating an exterior cover and a fixed exterior cover according to a second modification of the first embodiment of the present disclosure:

FIG. 14 is a cross-sectional view schematically illustrating a swinging locus of the exterior cover of FIG. 13 displayed when the exterior cover is opened according to the second modification of the first embodiment of the present disclosure;

FIG. 15 also is a cross-sectional view schematically illustrating an exterior cover and a fixed exterior cover according to a third modification of the first embodiment of the present disclosure;

FIG. 16 a cross-sectional view schematically illustrating an exterior cover and a fixed exterior cover according to a first related art;

FIG. 17 is a horizontal cross-sectional view schematically illustrating an exemplary sheet feeding unit openable cover and a sheet feeding unit fixed cover according to a second embodiment of the present disclosure;

FIG. 18 is a perspective view schematically illustrating the sheet feeding unit openable cover and the sheet feeding unit fixed cover of FIG. 17;

FIG. 19 is an enlarged perspective view schematically illustrating a bottom right portion of the sheet feeding unit openable cover shown in FIG. 18 before the sheet feeding unit openable cover is attached to the sheet feeding unit fixed cover according to the second embodiment of the present disclosure;

FIG. 20 is a cross-sectional view schematically illustrating the sheet feeding unit openable cover and the sheet feeding unit fixed cover when along the line H-H drawn in FIG. 17 according to the second embodiment of the present disclosure;

FIG. 21 also is a horizontal cross-sectional view schematically illustrating a sheet feeding unit openable cover and a sheet feeding unit fixed cover according to first modification of the second embodiment of the present disclosure;

FIG. 22A is a horizontal cross-sectional view again schematically illustrating the sheet feeding unit openable cover and the sheet feeding unit fixed cover according to the second modification of the second embodiment of the present disclosure;

FIG. 22B is a cross-sectional view schematically illustrating the sheet feeding unit openable cover and the sheet feeding unit fixed cover of FIG. 22A, which is along the line j-j in FIG. 22A;

FIG. 23 is a diagram schematically illustrating an exemplary sheet feeding unit openable cover and a sheet feeding unit fixed cover according to a third modification of the second embodiment of the present disclosure;

FIG. 24 is a diagram schematically illustrating an exemplary rear gap formed (on a backside) between a sheet feeding unit openable cover and a sheet feeding unit fixed cover according to a third modification of the second embodiment of the present disclosure;

FIGS. 25A and 25B are diagrams collectively illustrating an exemplary sheet feeding unit openable cover according to a fourth modification of the second embodiment of the present disclosure;

FIG. 25A is a horizontal cross-sectional view again schematically illustrating the sheet feeding unit openable cover and the sheet feeding unit fixed cover according to the fourth modification of the second embodiment of the present disclosure;

FIG. 25B is also a cross-sectional view along the line L-L in FIG. 25A according to the fourth modification of the second embodiment of the present disclosure;

FIG. 26 is a horizontal cross-sectional view again schematically illustrating a sheet feeding unit openable cover and a sheet feeding unit fixed cover according to a fifth modification of the second embodiment of the present disclosure; and FIG. 27 is also a horizontal cross-sectional view schematically illustrating a sheet feeding unit openable cover and a sheet feeding unit fixed cover according to a second related art.

DETAILED DESCRIPTION

Figure 2:
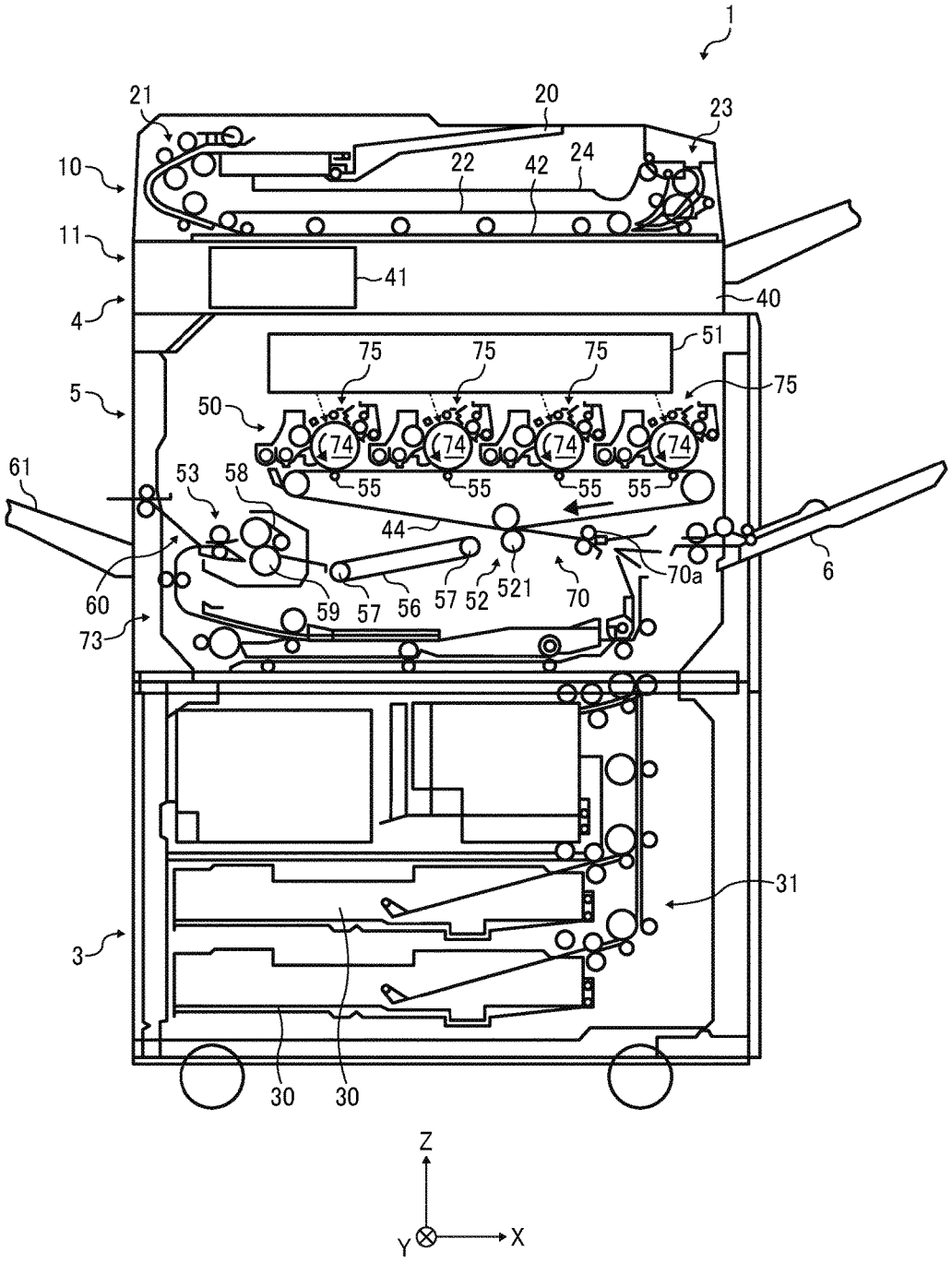
FIG. 2 is a front view schematically illustrating an exemplary image forming apparatus according to the first embodiment of the present disclosure.

Referring now to the drawings, wherein like reference numerals designate identical or corresponding member throughout the several views of the drawings, and in particular to FIG. 2, an image forming apparatus, to which the present disclosure is applied, is herein below briefly described. FIG. 2 is a front view schematically illustrating an exemplary image forming apparatus 1 as an image forming apparatus according to the first embodiment of the present disclosure. As shown there, the image forming apparatus 1 is a tandem color image forming apparatus. The image forming apparatus 1 is composed of an automatic original document feeder (hereafter simply referred to as an ADF) 10 and an image forming apparatus body 11. The image forming apparatus body 11 is configured by including an image forming unit 5 to form an image on a sheet acting as a recording medium, a sheet feeding unit 3 to feed a sheet to the image forming unit 5, and an image reading unit 4.

The ADF 10 is configured by including an original document tray 20, multiple original document sheet feeding rollers 21, an original document conveyor belt 22, multiple original document sheet ejecting rollers 23, and a document ejected tray 24. The ADF 10 is attached to the image reading unit 4 to freely open and close the image reading unit 4. The image reading unit 4 is configured by including a reading unit housing 40, an optical scanning unit 41, and a contact glass 42. The contact glass 42 is disposed on a top of the reading unit housing 40 of the image reading unit 4 to constitute an upper surface of the reading unit housing 40.

The sheet feeding unit 3 includes three sheet cassettes 30 and a sheet feeding system 31. These three sheet cassettes 30 accommodate multiple sheets as media of different sheet sizes from each other. The sheet feeding system 31 carries sheets stored in the sheet cassettes 30 up to a main sheet conveying path 70 provided in the image forming unit 5. An openable exterior cover 6 is attached to a side face of the image forming unit 5 and swings on a hinge to open and close the image forming unit 5 of the image forming apparatus 1 to function as a manual sheet setting tray. Hence, when the openable exterior cover 6 is opened, a top most sheet among a bunch of sheets manually set to an upper surface of the openable exterior cover 6 is sent by a feeding roller toward a main sheet conveying path 70. On the main sheet conveying path 70, a pair of registration rollers 70*a* is disposed. The pair of registration rollers 70*a* sandwiches a sheet conveyed in the main sheet conveying path 70 between two rollers thereof and subsequently sends the sheet toward a secondary transfer nip at a given time.

The image forming unit 5 includes an exposing unit 51, a tandem image forming system 50, an intermediate transfer belt 44, multiple intermediate transfer rollers 55, a secondary transfer device 52, a fixing unit 53, the main sheet conveying path 70, a sheet reversing conveying path 73, and a sheet ejecting path 60 or the like. As shown in FIG. 2, the exposing unit 51 is placed adjacent to the tandem image forming system 50 and exposes each of the four photoconductors 74 corresponding to respective component colors. The tandem image forming system 50 includes image forming sections 75 of yellow, cyan, magenta, and black colors placed side by side on the intermediate transfer belt 44 in a direction of rotation of the intermediate transfer belt 44, respectively. Each of the image forming sections 75 includes an electric charger, a developing device, a photoconductor cleaner, and an electric charge remover or the like around the photoconductor 74. The electric charger, the developing device, the photoconductor cleaner, and the electric charge remover or the like integrally constitute a process cartridge removable from the image forming apparatus body 11.

In the tandem image forming system 50, multiple toner images are formed on the respective photoconductors 74 based on image information read and separated into component colors by the image reading unit 4. Each of the toner images formed on the respective photoconductors 74 is primarily transferred onto the intermediate transfer belt 44. On an opposite side of the tandem image forming system 50 across the intermediate transfer belt 44, there is provided a secondary transfer device 52. The secondary transfer device 52 includes a secondary transfer roller 521 acting as a secondary transfer device. By pressing the secondary transfer roller 521 against the intermediate transfer belt 44, a secondary transfer nip is formed. In the secondary transfer nip, the toner images transferred onto the intermediate transfer belt 44 are secondarily transferred onto a sheet conveyed from the sheet feeding unit 3.

The sheet with the toner images (i.e., a full color toner image) transferred in the secondary transfer nip is further fed to the fixing unit 53 by a sheet conveying belt 56 stretched by a pair of supporting rollers 57. The fixing unit 53 is configured by a pressing roller 59 and a fixing belt 58 acting as an endless belt. The pressing roller 59 is pressed against the fixing belt 58 thereby forming a fixing nip therebetween. In the fixing unit 53, by applying heat and pressure to the sheet from the pressing roller 59 thereby rendering toner in the toner image to melt, the toner image transferred onto the sheet is fixed onto the sheet. The sheet bearing the toner image fixed thereon is then stacked on the sheet ejected tray 61 disposed outside the image forming apparatus 1 after passing through a sheet ejecting path 60 acting as a sheet conveying and ejecting path.

As shown in FIG. 2, below both the secondary transfer device 52 and the fixing unit 53, there is provided a sheet reversing conveying path 73. To form toner images on both sides of the sheet, the sheet reversing conveying path 73 turns the sheet ejected from the fixing unit 53 upside-down and further conveys the sheet again to the secondary transfer device 52 through the main sheet conveying path 70.

Figure 3:
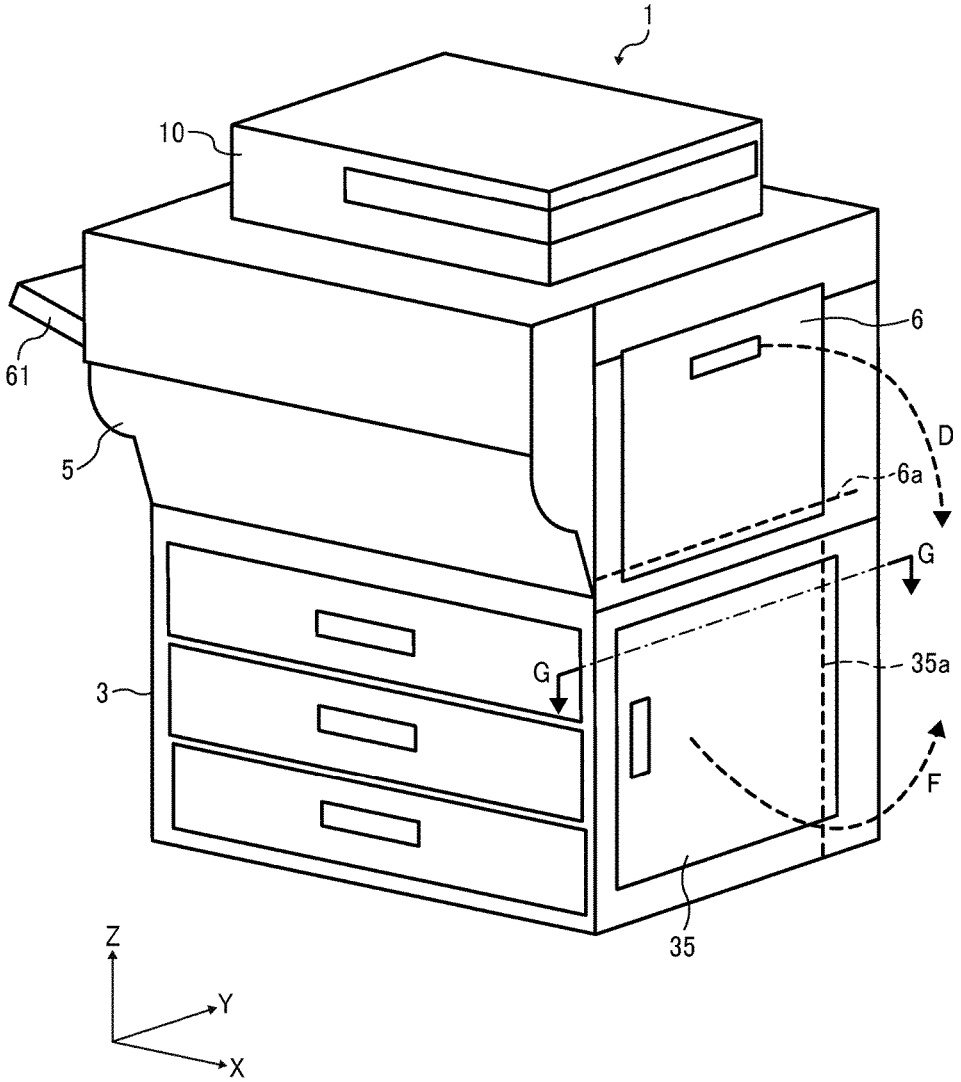
FIG. 3 is a perspective view schematically illustrating the image forming apparatus of FIG. 2 according to the first embodiment of the present disclosure.

The image forming apparatus 1 is described in detail with reference to FIG. 3. FIG. 3 is a perspective view schematically illustrating the image forming apparatus 1. As shown there by arrow D, by swinging the openable exterior cover 6 around a hinge 6*a*, an exterior of a right side of the image forming apparatus 1 is partially opened. By contrast, by swinging the openable exterior cover 6 around the hinge 6*a* in an opposite direction to that shown by the arrow D, an opened portion of the image forming apparatus 1 is closed. Further, as shown by arrow F in FIG. 3, by swinging a sheet feeding unit openable cover 35 around a vertical hinge 35*a*, the exterior of the right side of the sheet feeding unit 3 of the image forming apparatus 1 is partially opened. By contrast, by swinging the sheet feeding unit openable cover 35 around the vertical hinge 35*a* in the opposite direction to that shown by the arrow F, an opened portion of the image forming apparatus 1 is closed.

FIG. 4 is an enlarged view schematically illustrating the image forming unit 5 and the exemplary openable exterior cover 6 of the image forming apparatus 1, which is taken from a right side of in FIG. 2 when the openable exterior cover 6 is closed. FIG. 5 is an enlarged perspective vie illustrating a bottom right portion of the openable exterior cover 6 and surroundings thereof shown in FIG. 4. Here, a cross section along the line A-A drawn in FIG. 4 corresponds to FIG. 1 illustrating the openable exterior cover 6 and the non-openable exterior cover the upper cover 2 and the right side surface bottom cover 7 each on the right side surface).

FIG. 6 also is a cross-sectional view schematically illustrating an exemplary swinging locus displayed by the openable exterior cover 6 when the openable exterior cover 6 is opened from a closed state shown in FIG. 1. As shown there, when the openable exterior cover 6 in the closed state shown by a solid line in FIG. 6 swings on the hinge 6*a* in a direction as shown by arrow D in FIG. 6, the openable exterior cover 6 can be displaced to an opening position as shown by a dashed line in FIG. 6. As shown in FIG. 6, a pivoting angle of the openable exterior cover 6 caused when the openable exterior cover 6 of the image forming apparatus 1 in this embodiment of the present disclosure swings from the closed state to the open state is about 90 degrees. However, the present disclosure is not limited thereto.

Further, as shown in FIGS. 1, 3, and 4, the exterior on the right side surface of the image forming unit 5 is configured by three exterior covers (i.e., the upper cover 2 on the right side surface, the right side surface bottom cover 7 on the right side surface, and the openable exterior cover 6). As shown in FIGS. 4 and 5, near left and right side bottoms of the openable exterior cover 6, a pair of cylindrical pivoting shaft projections 6*d* is provided to jut out from left and right side edges of the openable exterior cover 6, respectively. Hence, the openable exterior cover 6 is attached to the right side surface bottom cover 7 on the right side surface with the pivoting shaft projections 6*d* inserted into a pair of hinge fitting holes 7*b* provided in the right side surface bottom cover 7 on the right side surface. With this, as shown in FIG. 6, the openable exterior cover 6 becomes swingable from and to the right side surface upper cover 2 and the right side surface bottom cover 7 on the right side surface. A centerline of the cylindrical pivoting shaft projections 6*d* provides a hinge 6*a* of the openable exterior cover 6 as a virtual line.

By swinging the openable exterior cover 6 and closing the image forming apparatus 1 thereby bringing the openable exterior cover 6 into a state shown in FIG. 1, internal and external spaces of the image forming apparatus 1 are partitioned by the openable exterior cover 6. In FIG. 1, the left side of the openable exterior cover 6 is an interior of the image forming apparatus 1 and the right side thereof is an exterior of the image forming apparatus 1. In this embodiment of the present disclosure, the right side surface upper cover 2 and the right side surface bottom cover 7 serve as adjacent covers provided adjacent to the openable exterior cover 6. Here, the right side surface upper cover 2 and the right side surface bottom cover 7 each provided on the right side surface are non-openable covers (i.e., not swingable) together with the openable exterior cover 6. Hence, the right side surface bottom cover 7 constitutes an openable cover supporter to support the openable exterior cover 6.

In the image forming apparatus 1, various sounds, such as a driving sound generated by a drive motor that communicates rotation driving force to various rollers, a moving sound generated by a moving member (e.g., various types of rollers), a rotating sound generated by a polygon mirror provided in the optical scanning unit 41, etc., are generated. Such sounds travel to the exterior of the image forming apparatus 1 and become noises thereby offending people around the image forming apparatus 1. However, the right side surface upper cover 2 and the right side surface bottom cover 7 and the openable exterior cover 6 or the like which partition a space into the inside and the outside of the image forming apparatus 1 inhibit the sound generated therein to travel outside thereby suppressing generation of the noises in the outside.

As shown in FIGS. 1 and 4, a gap exists between a leading side edge (i.e., an upper side in FIGS. 1 and 4) of the openable exterior cover 6 in the closed state and the right side surface upper cover 2 (hereinafter simply referred to as a tip side gap 12). As also shown in FIG. 4, multiple gaps are formed at the same time between each of lateral ends of the openable exterior cover 6 and the tight side surface bottom cover 7 on the tight side surface, respectively (hereinafter simply referred to as side edge gaps 18). Further, as shown in FIGS. 1 and 4, a gap is also formed between an side edge of a supported side (i.e., a lower side in FIGS. 1 and 4) of the openable exterior cover 6 (i.e., a side of the hinge 6*a*) and the right side surface bottom cover 7 (hereinafter simply referred to as a supported side gap 17) on the right side face.

That is, the gaps are formed between the edges of four sides (i.e., the tip side, both the lateral sides, and the supported side) of the openable exterior cover 6 and the right side surface upper cover 2 and the right side surface bottom cover 7 acting as the adjacent covers on the tight side surface. With this, when the openable exterior cover 6 is opened and closed, the openable exterior cover 6 can prevent interference with both the right side surface upper cover 2 and the right side surface bottom cover 7 each on the right side surface. However, since each of the tip side gap 12, the side edge gaps 18, and the supported side gap 17 serves as a communication gap that communicates the interior of the image forming apparatus 1 with the exterior thereof across the openable exterior cover of the image forming apparatus 1, sound generated inside the image forming apparatus 1 has a risk to escape to the outside via these communication gaps.

Further, in a housing with an openable cover, such as the openable exterior cover 6, etc., swingable around a hinge to open and close a body (i.e., a housing), a gap is needed between an edge of one side of the openable cover, at which the hinge is provided, and an adjacent cover with its side edge located adjacent to the one side edge of the openable cover for the reasons described below.

First, ideally, the gap can be eliminated when the openable cover is closed by bringing the side edge of the openable cover on the hinge side in contact with the adjacent cover. However, each of the openable cover and the adjacent cover as a practical matter has a prescribed thickness. For this reason, when the openable cover swings on the hinge with its end face on the hinge side contacting the adjacent cover, the adjacent cover enters a swinging locus of the end face of the openable cover. As a result, the openable cover cannot be opened and closed. Otherwise, whenever the openable cover is opened and closed, the side edge of the openable cover on the hinge side contacts the side edge of the adjacent cover, thereby either easily damaging the side edge or being itself damaged. Secondly, in view of component tolerance, assembly tolerance, and performance of openable operation, the gap is needed as a practical matter.

Because of this, the gap is generally formed between the side edge of the openable cover on the hinge side and the adjacent cover adjacent to the side edge of the openable cover on the hinge side. However, a problem is that sound generated inside the housing may escape to the outside of the housing via this gap thereby creating a risk to generate a noise.

To resolve such a problem, in the image forming apparatus 1 of this embodiment of the present disclosure, a labyrinth composed of multiple bending portions is formed in the supported side gap 17 formed between the side edge of the openable exterior cover 6 acting as an openable cover on the supported end side and the right side surface bottom cover 7 acting as the adjacent cover on a right side surface of the image forming apparatus 1. Because of this, sound generated in the image forming apparatus 1 and heading to the outside of the image forming apparatus 1 through the supported side gap 17 cannot go outside of the image forming apparatus 1 unless it is diffracted multiple times by the labyrinth of the supported side gap 17. Hence, even in a system in which the gap is formed between the side edge of the openable exterior cover 6 on the supported end side and the right side surface bottom cover 7, noise can be effectively suppressed.

Now, the labyrinth formed in the supported side gap 17 is more specifically described with reference to applicable drawings. As shown in FIG. 1, the openable exterior cover 6 includes an openable cover supported end projection 6*b* that projects into an inner side of the image forming apparatus 1 from the side edge of the supported end of the openable exterior cover 6. The right side surface bottom cover 7 on the right side surface includes an opening section bottom face 7*c* facing the side edge of the supported end of the openable exterior cover 6 and a bottom cover projection 7*a* extended upward from the opening section bottom face 7*c*. Hence, the openable cover supported end projection 6*b* enters an interior of a recess formed by the opening section bottom face 7*c* and a face of the bottom cover projection 7*a* when the openable exterior cover 6 is closed. Hence, the supported side gap 17 is formed by the opening section bottom face 7*c* and the bottom cover projection 7*a* placed to face and collectively surround three sides of the tip of the openable cover supported end projection 6*b* without contacting the opening cover supported end projection 6*b*. With such a configuration, an air passage starting from the interior of the image forming apparatus 1 and directed to the outside of the image forming apparatus 1 through the supported side gap 17 is shaped to include multiple bending portions.

Hence, as shown in FIG. 1, out of the entire sound proceeding in a direction as shown by arrow "a", a prescribed amount of sound is diffracted in a first diffraction opening 17*a* formed in the supported side gap 17 between the tip side face of the bottom cover projection 7*a* and an inner face of openable exterior cover 6 and proceeds in a direction as shown by arrow "b". Subsequently, out of the entire sound proceeding in the direction shown by arrow "b", a prescribed amount of sound is further diffracted in a second diffraction opening 17*b* formed in the supported side gap 17 between a face of the bottom cover projection 7*a*, which neighbors to the tip side face of the bottom cover projection 7*a*, and the tip of the openable cover supported end projection 6*b* and proceeds in a direction as shown by arrow "c" in FIG. 1 as well. After that, out of the entire sound proceeding in the direction shown by arrow "c", a prescribed amount of sound is yet further diffracted in a third diffraction opening 17*c* formed in the supported side gap 17 between the tip side face of the openable cover supported end projection 6*b* and a face of the bottom cover projection 7*a*, which is opposed to the tip side face of the openable cover supported end projection 6*b*, and further proceeds in a direction as shown by arrow "d" in FIG. 1 as well. In this way, by providing a structure, in which sound caused in the image forming apparatus 1 does not readily escape outside of the image forming apparatus 1 unless it undergoes diffraction multiple times in the supported side gap 17, the sound can be effectively insulated.

Further, as also shown in FIG. 1, the openable exterior cover 6 also includes an openable cover tip projection 6*c* at an side edge of a tip of the openable exterior cover 6, which again projects toward the inner side of the image forming apparatus 1. The right side surface upper cover 2 (i.e., the adjacent cover 2) includes an opening section upper end face 2*c* that faces the side edge of the tip side of the openable exterior cover 6 an upper cover projection 2*a* extended downward from the opening section upper end face 2*c*. Hence, the openable cover tip projection 6*c* enters the interior of a recess formed by the opening section upper end face 2*c* and the upper cover projection 2*a* when the openable exterior cover 6 is closed. Hence, a tip side gap 12 is formed by the opening section upper end face 2*c* and a face of the upper cover projection 2*a* opposed to collectively surround three sides of the chip of the openable cover tip projection 6*c* without contacting the openable cover tip projection 6*c*. Again, similar to the supported side gap 17, the tip side gap 12 also includes a labyrinth composed of multiple bending portions as well. Hence, sound insulation can be effectively demonstrated in the same way as described earlier as well.

Furthermore, a labyrinth is similarly employed in each of both side edge gaps 18, additionally. As a result, noise generated inside the image forming apparatus 1 can be more effectively suppressed even in a configuration having multiple gaps between all of four sides of the openable exterior cover 6 and the adjacent covers (i.e., the right side surface upper cover 2 and the right side surface bottom cover 7).

FIG. 16 illustrates a related art of a configuration, in which a supported side gap 17 is formed with a labyrinth between an openable exterior cover 6 and a right side surface bottom cover 7 but the openable exterior cover 6 cannot smoothly pivot (i.e., neither opened nor closed) thereby raising a problem. As described earlier, the sound generated in the image forming apparatus 1 travels to the outside of the image forming apparatus 1 from the gap formed between the exterior covers, thereby generating the noise. In particular, an openable cover such as the openable exterior cover 6, etc., is prone to cause a gap in a boundary connecting to the other exterior cover. To solve such a problem, as also described above, by employing the labyrinth in the gap of the boundary between the exterior covers, the noise therefrom can be effectively suppressed.

In such a situation, out of four side edges in the respective sides of the openable cover to provide four boundaries between the openable cover and the other adjacent exterior covers, three side edges of the openable cover other than remaining one side edge of the cover located on the hinge side can relatively easily employ the labyrinths, respectively. That is, it is relatively difficult for the remaining one side edge of the openable cover located on the hinge side to employ the labyrinth a described below. Because, when the openable cover is opened by swinging the openable cover toward the outside of the image forming apparatus 1 around the hinge, since the side edge of the hinge side of the openable cover is located on the opposite side to the tip of the openable cover across the hinge, the side edge of the hinge side of the openable cover moves into the interior of the image forming apparatus 1. At this moment, since the labyrinth of the side edge of the openable cover on the hinge side interferences with the labyrinth of the other external cover, the openable cover cannot be opened anymore depending on a situation sometimes.

Specifically, in the related art of FIG. 16, when the openable exterior cover 6 is opened by swinging the openable exterior cover 6 around the hinge 6*a* toward the outside of the image forming apparatus 1 in a direction as shown by arrow D in FIG. 16, the openable cover supported end projection 6*b* moves into the interior of the image forming apparatus 1 as shown by arrow D' in FIG. 16. However, with such a configuration of the related art of FIG. 16, on a swinging locus of the openable cover supported end projection 6*b* formed at the side edge of the openable exterior cover 6 on the supported end side with the labyrinth, the bottom cover projection 7*a* formed on the body (i.e., the other external cover) with the labyrinth is positioned. For this reason, the openable cover supported end projection 6*b* and the bottom cover projection 7*a* interfere with each there, the openable exterior cover 6 cannot reach an opened position as shown by a dashed line in FIG. 16.

To solve such a problem, in the image forming apparatus 1 of this embodiment of the present disclosure, the hinge 6*a* of the openable exterior cover 6 is located inside the labyrinth as shown in FIGS. 1 and 6. Specifically, as shown in the drawings, when viewed in a direction parallel to the hinge 6*a*, the hinge 6*a* is located inside the recess formed by the opening section bottom face 7*c* and the bottom cover projection 7*a*. Hence, since the hinge 6*a* is located inside the recess, a radius of rotation of the openable cover supported end projection 6*b* located inside the recess with the labyrinth in a closed state can be reduced when the openable exterior cover 6 swings on the hinge 6*a*.

As shown in FIG. 6, when the openable exterior cover 6 is opened around the hinge 6*a* in a direction as shown by arrow D in FIG. 6 toward the outside of the image forming apparatus 1, the openable cover supported end projection 6*b* swings in a direction as indicated by arrow E in FIG. 6 around the hinge 6*a*. Since a pivoting radius of the openable cover supported end projection 6*b* is relatively small, the openable cover supported end projection 6*b* can pivot in the recess without interfering with the bottom cover projection 7*a*. Hence, the labyrinth can be employed in the supported side gap 17. Accordingly, while maintaining a gap (i.e., the supported side gap 17) needed for the openable exterior cover 6 to smoothly swing, noise therefrom can be inhibited.

FIG. 7 is a cross-sectional view schematically illustrating the openable exterior cover and the adjacent cover shown in FIG. 1, which is along the line B-B in FIG. 1. As shown in FIG. 1, the openable cover supported end projection 6*b* projects perpendicular to an openable cover exterior surface 6*f* of the openable exterior cover 6. The opening section bottom face 7*c* and the face of the bottom cover projection 7*a* are opposed to and collectively surround the three sides of the openable cover supported end projection 6*b*. Hence, as shown in FIG. 7, in a cross section parallel to the openable cover exterior surface 6*f*, the openable cover supported end projection 6*b*, and the right side surface bottom cover 7 and the bottom cover projection 7*a* collectively forming a recess surrounding the openable cover supported end projection 6*b* are positioned. With this, the supported side gap 17 can be shaped into the labyrinth having more than one deflecting portion.

Now, an image forming apparatus 1 of a first modification of the first embodiment of the present disclosure (hereinafter simply referred to as a first modification) is described with reference to FIGS. 8A and 8B and applicable drawings. FIGS. 8A and 8B are diagrams collectively illustrating an exemplary openable exterior cover 6 schematically employed in the image forming apparatus 1 of the first modification. In particular, FIG. 8A is a cross-sectional view schematically illustrating an openable exterior cover 6 and an fixed exterior cover (i.e., a right side surface upper cover 2 and a right side surface bottom cover 7), which is similarly along the line A-A in FIG. 4. FIG. 8B is a cross-sectional view along the line C-C drawn in FIG. 8A.

FIG. 9 is a cross-sectional view schematically illustrating an exemplary swinging locus of the openable exterior cover 6 displayed from a state (i.e., a closed state) as shown in FIG. 8A to a state in which the openable exterior cover 6 is opened up. As shown there, by swinging the openable exterior cover 6 from a closed state thereof as shown by a solid line in FIG. 9 around the hinge 6*a* in the direction as shown by arrow D, the openable exterior cover 6 can reach an opened position as shown by a dashed line in FIG. 9. As shown there, in the image forming apparatus 1 of the first modification of the first embodiment of the present disclosure, a pivoting angle of the openable exterior cover 6 when it swings from the closed state to the open state is more than about 90 degrees.

FIG. 10 is a perspective view schematically illustrating the openable exterior cover 6 and the fixed exterior cover (e.g., the right side surface upper cover 2 and the right side surface bottom cover 7 o the like) of the image forming apparatus 1 of the first modification of the first embodiment of the present disclosure. That is, a local cross-sectional view of the openable exterior cover 6 along a line drawn in the middle of the coordinate axis Y is shown. FIGS. 11A and 11B are partially enlarged perspective views of FIG. 10 according to the first modification of the first embodiment of the present disclosure. In particular, FIG. 11A is an enlarged view schematically illustrating an area α indicated in FIG. 10 according to the first modification of the first embodiment of the present disclosure. FIG. 11B is also an enlarged view schematically illustrating an area β indicated in FIG. 10 according to the first modification of the first embodiment of the present disclosure.

In the first modification of the first embodiment of the present disclosure, similar to the configuration of FIG. 1, the hinge 6*a* of the openable exterior cover 6 of the image forming apparatus 1 is placed inside the recess again. As different from the configuration of FIG. 1, the openable exterior cover 6 of the first modification of the first embodiment of the present disclosure includes multiple openable cover supported end projections 6*b* as shown in FIGS. 8A and 8B.

That is, the multiple openable cover supported end projections 6*b* are more advantageous than only one openable cover supported end projection 6*b* as described below. That is, when a gap between the tip side face of the openable cover supported end projection 6*b* and a vertically extended side face of the bottom cover projection 7*a* opposed to the tip side face of the openable cover supported end projection 6*b* narrows, a distance from the hinge 6*a* to the tip of the openable cover supported end projection 6*b* necessarily increases. In such a situation, in order to suppress interference between the tip of the openable cover supported end projection 6*b* and the bottom cover projection 7*a* when the openable exterior cover 6 swings, a gap (i.e., a vertical gap) between an upper surface of the openable cover supported end projection 6*b* and a lower surface of a portion of the bottom cover projection 7*a*, which is horizontally extended at its upper portion, need to be wider when the openable exterior cover is closed. However, when the gap is widened, reduction efficiency of the noise by means of the labyrinth decreases.

To solve such a problem, in the first modification of the first embodiment of the present disclosure, multiple openable cover supported end projections 6*b* are employed as shown in FIGS. 8 and 9. For example, three openable cover supported end projections 6*b* are used in a configuration shown in FIGS. 8 and 9. More specifically, out of vertically aligned three openable cover supported end projections 6*b*, a middle openable cover supported end projection 6*b* located at a center projects into the left in FIG. 8A toward the one side face of the bottom cover projection 7*a*, which also extends vertically. Hence, the gap between the middle openable cover supported end projection 6*b* and the surface of the bottom cover projection 7*a* narrows. In such a situation, although the openable cover supported end projection 6*b* projects into the left in FIG. 8A toward the surface of the bottom cover projection 7*a*, since the hinge 6*a* is located at a base of this openable cover supported end projections 6*b*, a radius of rotation of the tips of the openable cover supported end projections 6*b* can be reduced.

Out of vertically aligned three openable cover supported end projections 6*b*, the uppermost openable cover supported end projection 6*b* located at the top of them slightly projects to the left in FIG. 8A toward the side face of the bottom cover projection 7*a*. However, a gap between an upper face of the uppermost openable cover supported end projection 6*b* and a lower face of the bottom cover projection 7*a*, which extends horizontally at the upper portion of the bottom cover projection 7, narrows.

Also, out of vertically aligned three openable cover supported end projections 6*b*, the lowermost openable cover supported end projection 6*b* located at the bottom of them also slightly projects to the left in FIG. 8A toward the side face of the bottom cover projection 7*a*. However, a gap between a lower face of the bottommost openable cover supported end projection 6*b* and the opening section bottom face 7*c* narrows again. With such as a configuration, since these gaps between the inner three faces of the recess and the openable cover supported end projections 6*b* can narrows down, suppressing efficiency of noise therefrom can be upgrade while enabling the openable cover supported end projections 6*b* to smoothly pivot inside the recess. Further, with the multiple openable cover supported end projections 6*b*, it becomes possible to adjust a size of the supported side gap 17 formed between the openable cover supported end projections 6*b* and the recess without thickening the openable cover supported end projection 6*b*.

Further, in this modification of the first embodiment of the present disclosure, as connectors to connect the openable cover supported end projections 6*b* to each other, multiple projection reinforcing ribs 6*e* are disposed therebetween. That is, at multiple positions in a direction perpendicular to a plane of the FIG. 8A (i.e., a coordinate axis Y), there are provided the projection reinforcing ribs 6*e*, respectively. Hence, both strength and sound shielding property are upgraded while precisely adjusting the width of the supported side gap 17 as well.

Further, in this modification of the first embodiment of the present disclosure, as shown in FIG. 8A, the openable exterior cover 6 in the closed state of the image forming apparatus 1 includes an openable cover sloping portion 6*g* inclining to the openable cover exterior surface 6*f* at the bottom thereof. In addition, in a section of the right side surface bottom cover 7 opposed to the openable cover sloping portion 6*g*, a bottom cover sloping portion 7*d* sloped to a bottom cover exterior surface 7*f* of the right side surface bottom cover 7 is also provided. Due to provision of both the openable cover sloping portion 6*g* and the bottom cover sloping portion 7*d*, the openable exterior cover 6 can increasingly pivot by angle of more than 90 degrees without causing interference of the bottom end of the openable exterior cover 6 and the right side surface bottom cover 7 with each other. With this, maintenance on inner parts and visibility of an interior each needed when the openable exterior cover 6 is opened can be upgraded.

However, as a degree of pivotable angle of the openable exterior cover 6 increases, the gap between the side edge of the openable exterior cover 6 on the supported end side and the right side surface bottom cover 7 becomes wider, thereby enhancing a risk of noise. To solve such a problem, due to provision of the openable cover sloping portion 6*g* and the bottom cover sloping portion 7*d* in the first modification of the first embodiment of the present disclosure, a portion of the supported side gap 17 in the vicinity of the side edge of the external side of the exterior cover (6) is tapered so that the portion of the supported side gap 17 narrows toward the inner side of the image forming apparatus 1 (i.e., on the left side in FIG. 8A). With this, while narrowing down the gap even at a position, at which the side edge of the supported end of the openable exterior cover 6 and the opening section bottom face 7*c* become closest to each other, the openable exterior cover 6 can increasingly widely pivot by angle of more than 90 degrees. Consequently, while increasing the degree of the pivotable angle of the openable exterior cover 6, a function to suppress the noise can be maintained at the same time as well.

Now, an image forming apparatus 1 of a second modification of the first embodiment of the present disclosure (hereinafter simply referred to as a second modification) is described with reference to FIG. 13. FIG. 13 is a cross-sectional view along the line A-A in FIG. 4 and schematically illustrating an openable exterior cover 6 and a fixed exterior cover a right side surface upper cover 2 and a right side surface bottom cover 7) of the image forming apparatus 1 of the second modification. FIG. 14 also is a cross-sectional view schematically illustrating an exemplary locus displayed by the openable exterior cover 6 when the openable exterior cover 6 is opened from a closed state as shown in FIG. 13. As shown there, when the openable exterior cover 6 in the closed state as shown by a solid line in FIG. 9 swings on a hinge 6*a* in a direction as shown by arrow D in the drawing, the openable exterior cover 6 can reach an opened position as shown by a dashed line in FIG. 9.

A shown there, in the image forming apparatus 1 of the second modification, a recess is formed near an side edge of the openable exterior cover 6 on a supported end side to surround three sides of a tip of a bottom cover projection 7*a*. The hinge 6*a* is located inside the recess again. In the image forming apparatus 1 of the second modification, a supported side gap 17 is formed between the recess and the bottom cover projection 7*a* and is shaped into a labyrinth. With the above-described configuration of the second modification, as in the above-described configuration of the first embodiment of the present disclosure, noise can be effectively suppressed while maintaining a prescribed size of gap needed for the openable exterior cover 6 to smoothly swing as well.

Now, an image forming apparatus 1 of a third modification of the first embodiment of the present disclosure (hereinafter simply referred to as a third modification) is described with reference to FIG. 15 and applicable drawings. FIG. 15 is a cross-sectional view along the line A-A in FIG. 4 and schematically illustrating an openable exterior cover 6 and a fixed exterior cover (i.e., a right side surface upper cover 2 and a right side surface bottom cover 7) of the image forming apparatus according to the third modification. As shown there, a swinging locus displayed by the openable exterior cover 6 when the openable exterior cover 6 is opened from the closed state is illustrated.

As shown in FIG. 15, an image forming apparatus 1 of the third modification includes an inner cover 8 covered by the openable exterior cover 6 when the openable exterior cover 6 is closed. The inner cover 8 is fixed to a body frame of the image forming apparatus 1 together with the right side surface upper cover 2 and the right side surface bottom cover 7 to be a portion of the adjacent cover. Without contacting the face of the openable cover supported end projection 6*b*, the inner cover 8 is opposed to a chip side of the openable cover supported end projection 6*b* to surround the three sides of the chip of the openable cover supported end projection 6*b*. Thus, the inner cover 8 partially constitutes the recess that forms the supported side gap 17. Hence, in the image forming apparatus 1 of the third modification, the supported side gap 17 provides a labyrinth, so that noise therefrom can be effectively suppressed while maintaining a prescribed size of gap necessary for the openable exterior cover 6 to smoothly pivot again.

Heretofore, in the above-described embodiment and various modifications, the openable exterior cover 6 is a vertically openable type, in which the openable exterior cover 6 is vertically opened around the hinge 6*a* extended horizontally. However, the above-described labyrinth employed in each of the supported side gap 17, the tip side gap 12, and the side edge gaps 18 can be applied equally well to a laterally openable sheet feeding unit openable cover 35 (see FIG. 3), in which the sheet feeding unit openable cover 35 is opened and closed horizontally around a vertical hinge 35*a* vertically extended as well.

Further, as described heretofore, the supported side gap 17 formed in the image forming apparatus 1 of the above-described embodiment and each of the modifications has a shape providing multiple bending portions in an air passage that linearly connects the interior with the exterior of the exterior cover to deflect sound multiple times. In this way, sound generated in the image forming apparatus 1 and heading to the exterior through the supported side gap 17 acting as an air passage cannot go outside of the image forming apparatus 1 unless otherwise it undergoes diffraction multiple times. Accordingly, by subjecting the sound to the diffraction multiple times, the sound can be attenuated thereby suppressing the noise again.

Hence, in the above-described embodiment and each of the modifications, the deflect that deflects air flow is formed by bending the cover at a right angle. However, the cover can be a continuously curved to form the deflection as well.

Further, in the above-described embodiment and each of the modifications, the supported side gap 17 formed between the openable exterior cover 6 acting as the openable cover and either the right side surface bottom cover 7 acting as the fixed exterior cover or the inner cover is shaped into the labyrinth. However, as a member to form the supported side gap 17 with the labyrinth, there is no requirement that it be limited to the exterior cover and the inner cover, and can be a portion of a body frame of the image forming apparatus 1. That is, the portion of a body frame may partially form the supported side gap 17. In such a situation, the body frame acts as the adjacent cover.

Further, as the openable cover that forms the gap on the supported end side thereof, there is no requirement that it be limited to a member that forms the exterior of the image forming apparatus 1, such as the openable exterior cover 6. For example, the openable cover can be a member exposed only after removing the exterior cover as well. In addition, the openable cover can be another member opened and closed by an interior cover (e.g., an inner cover) exposed when the exterior cover is opened. Furthermore, the openable cover that forms the gap on the openable cover supported end side is not limited to the exterior and interior covers of the image forming apparatus, and includes a cover that covers a housing installed in the image forming apparatus, such as an optical scanning unit 41, a drive unit, etc., as well.

In this embodiment of the present disclosure, the image forming apparatus is exemplified as the housing that includes the openable cover. However, the housing including the openable cover of the present disclosure can be similarly applied to an electronic device other than the image forming apparatus as well as long as it includes a sound source that generates sound during operation thereof and an openable cover which partitions the device into an interior accommodating the sound source therein and an exterior thereof as well. Further, the present disclosure is not limited to an electronic device, but is applicable to any housing as long as it is required to suppress noise from an interior to an exterior thereof as well. That is, the labyrinth of the present disclosure can be employed in a gap of an openable cover on a supported end side in the housing.

Further, as a configuration of the labyrinth to be formed in the gap on the hinge side of the openable cover, there is no requirement that it be limited to the above-described configuration, in which the projection is formed in one of the openable cover and the adjacent cover and the recess is formed in the other one of the openable cover and the adjacent cover to surround the projection in the gap. That is, the present disclosure can be applied to any configuration as long as the configuration employs an openable cover and an adjacent cover required not to interfere with each other when the openable cover is opened and closed and a labyrinth in a gap formed on a hinge side of the openable cover.

Now, a second embodiment of the present disclosure is described with reference to FIGS. 17 to 20 and applicable drawings. FIG. 18 is an enlarged perspective view schematically illustrating an exemplary sheet feeding unit openable cover 35 and a sheet feeding unit fixed cover 9 when the sheet feeding unit openable cover 35 is closed. FIG. 19 also is an enlarged perspective view illustrating a bottom right of the exemplary sheet feeding unit openable cover 35 of FIG. 18 before the sheet feeding unit openable cover 35 is attached to the sheet feeding unit fixed cover 9. FIG. 17 is a cross-sectional view illustrating the sheet feeding unit openable cover 35 and the sheet feeding unit fixed cover 9 along the line G-G drawn in FIGS. 1 and 18.

As shown in FIG. 19, near a bottom of a rear side of the sheet feeding unit openable cover 35, there is provided a cylindrical vertical hinge projection 35*d* that projects downward from a lower side edge of the sheet feeding unit openable cover 35. Similarly, near an upper portion of the rear side of the sheet feeding unit openable cover 35, there is also provided a cylindrical vertical hinge projection 35*d* that projects upward from an upper side edge of the sheet feeding unit openable cover 35. Hence, the vertical hinge projection 35*d* fits into a vertical hinge projection engaged hole 9*b* formed on the sheet feeding unit fixed cover 9 thereby attaching the sheet feeding unit openable cover 35 to the sheet feeding unit fixed cover 9 at the same time. Hence, as shown by arrow F in FIGS. 3 and 17, the sheet feeding unit openable cover 35 can pivot and separates from the sheet feeding unit fixed cover 9. Here, a central line of the cylindrical vertical hinge projection 35*d* as a virtual line provides a vertical hinge 35*a* as a hinge of the sheet feeding unit openable cover 35.

Accordingly, by swinging the sheet feeding unit openable cover 35 and closing the body of the image forming apparatus 1 in a state as shown in FIG. 17, internal and external spaces (i.e., interior and exterior) of the image forming apparatus 1 are partitioned by the sheet feeding unit openable cover 35. In FIG. 17, a left side across the sheet feeding unit openable cover 35 is the interior of the image forming apparatus 1 and a right side thereof is an exterior of the image forming apparatus 1. In this embodiment of the present disclosure, the sheet feeding unit fixed cover 9 acts as both the adjacent cover provided adjacent to the sheet feeding unit fixed cover 9 and an openable cover supporter to support the sheet feeding unit openable cover 35.

As described earlier, in the image forming apparatus 1, various sounds, such as a driving sound generated by a drive motor that propagates rotary driving force to various rollers, a moving sound generated by a moving member (e.g., various types of rollers), a rotating sound generated by a polygon mirror provided in the optical scanning unit 41, etc., occur. Such sounds travel to the exterior of the image forming apparatus 1 and are likely to become a noise thereby offending people therearound. However, the exterior cover, such as the sheet feeding unit fixed cover 9, the sheet feeding unit openable cover 35, etc., which partitions a space around the image forming apparatus 1 into the interior and the exterior, inhibits the sound generated therein to travel from the interior to the exterior thereby being able to suppress generation of the noise.

That is, as shown in FIGS. 17 and 18, between a front side edge (i.e., a bottom side in FIG. 1) of the sheet feeding unit openable cover 35 of the image forming apparatus 1 and a front frame 92 of the sheet feeding unit fixed cover 9, a gap (hereinafter simply referred to as a front gap 920) is formed when the sheet feeding unit openable cover 35 is closed. As also shown in FIG. 18, a gap (hereinafter simply referred to as an upper gap 930) is formed between an upper side edge of the sheet feeding unit openable cover 35 and an upper frame 93 of the sheet feeding unit fixed cover 9. As also shown in FIG. 18, a gap (hereinafter simply referred to as a bottom side gap 940) is formed in between a side edge of a bottom of the sheet feeding unit openable cover 35 and a bottom frame 94 of the sheet feeding unit fixed cover 9. As also shown in FIGS. 17 and 18, a gap (hereinafter simply referred to as an upper gap 930) is formed in between the rear side edge of the sheet feeding unit openable cover 35 on a side of the vertical hinge 35*a* (i.e., an upper side in FIG. 17) of the image forming apparatus 1 and a rear frame 91 of the sheet feeding unit fixed cover 9. In this embodiment of the present disclosure, both the front frame 92 and the rear frame 91 are portions of the sheet feeding unit fixed cover 9, and are composed of a single member. However, the front frame 92 and the rear frame 91 can be composed of separate members from each other, respectively.

That is, in this embodiment of the present disclosure, the gaps are formed between the four sides of the sheet feeding unit openable cover 35 (i.e., up and down, and front and rear side edges) and the sheet feeding unit fixed cover 9. With this, both when the sheet feeding unit openable cover 35 is opened and closed, the sheet feeding unit openable cover 35 can prevent interference with the sheet feeding unit fixed cover 9. However, since the front gap 920, the upper gap 930, the bottom side gap 940, and the rear gap 910 act as communication gaps communicating the interior of the image forming apparatus 1 with the exterior thereof across the exterior cover of the image forming apparatus 1, sound generated inside the image forming apparatus 1 is likely to escape to the outside via these communication gaps.

In a housing with an openable cover, such as the sheet feeding unit openable cover 35, etc., pivotable around a hinge to open and close a body (i.e., a housing), a gap is generally needed between an side edge of one side of the openable cover, at which the hinge is provided, and an adjacent cover with its side edge located adjacent to the one side edge of the openable cover for the reasons described below.

That is, as described earlier, the gap can be eliminated by bringing the side edge of the openable cover on the hinge side in contact with the adjacent cover when the openable cover is closed. However, each of the openable cover and the adjacent cover has a thickness. For this reason, when the openable cover with its end face on the hinge side brought in contact with the adjacent cover swings, the adjacent cover enters a swinging locus of the end face of the openable cover on the hinge side. As a result, the openable cover cannot be opened and closed. Otherwise, whenever the openable cover is opened and closed, the edge of the openable cover on the hinge side contacts the edge of the adjacent cover, thereby easily damaging the other cover or damaged. Further, in view of component tolerance, assembly tolerance, and openability of operation, the gap is necessarily employed as a practical matter.

Accordingly, the gap is needed between the edge of the openable cover on the hinge side and the adjacent cover adjacent to the side edge of the openable cover on the hinge side. However, sound generated inside the housing may escape to the outside through the gap thereby creating a risk to cause a noise. To resolve such a problem, in the image forming apparatus 1 of this embodiment of the present disclosure, a labyrinth composed of multiple bending portions is formed in the rear gap 910 formed between the side edge of the sheet feeding unit openable cover 35 acting as the openable cover on the hinge side and the rear frame 91 of the sheet feeding unit fixed cover 9. Because of this, sound generated in the image forming apparatus 1 and heading to the outside of the image forming apparatus 1 via the rear gap 910 undergoes diffraction multiple times there. Hence, even in such a system, in which the gap is formed between the side edge of the sheet feeding unit openable cover 35 on the hinge side and the rear frame 91 of the sheet feeding unit fixed cover 9, noise therefrom can be effectively suppressed.

The sheet feeding unit openable cover 35 includes an openable cover internally extended portion 35*b* that extends toward the inner side of the image forming apparatus 1 at the side edge of the rear side thereof. The sheet feeding unit openable cover 35 also includes an openable cover backwardly extended projection 35*c* projecting from the openable cover internally extended portion 35*b* toward the rear side thereof as well. In addition, as projections projecting from an opening rear end face 91*c* that faces the rear side edge of the sheet feeding unit openable cover 35 into the front side thereof the rear frame 91 of the sheet feeding unit fixed cover 9 includes both a rear fixed cover-tip side face facing projection 91*a* and a rear cover side-face opposing projection 91*b*. Hence, when the sheet feeding unit openable cover 35 is closed, the openable cover backwardly extended projection 35*c* enters an interior of a recess formed by faces of the rear fixed cover-tip side face facing projection 91*a* and the rear cover side-face opposing projection 91*b* and the opening rear end face 91*c*. That is, the rear gap 910 is formed by placing the rear fixed cover-tip side face facing projection 91*a*, the rear cover side-face opposing projection 91*b*, and the opening rear end face 91*c* at opposite positions to surround three sides of a tip of the openable cover backwardly extended projection 35*c* without contacting the openable cover backwardly extended projection 35*c*. With such a configuration, a route starting from the interior of the image forming apparatus 1 having the rear gap 910 and directed to the outside through the rear gap 910 includes multiple bending portions.

Hence, out of sound proceeding in a direction as shown by arrow "a" in FIG. 17, sound diffracted in a first diffraction opening 910*a* formed in the rear gap 910 between a tip of the openable cover backwardly extended projection 35*c* and the side face of the rear cover side-face opposing projection 91*b* proceeds in a direction as shown by arrow "b" in the drawing. Subsequently, out of the sound proceeding in the direction shown by arrow "b", sound diffracted in a second diffraction opening 910*b* formed in the rear gap 910 between the tip side face of the openable cover backwardly extended projection 35*c* and the opening rear end face 91*c* proceeds in a direction as shown by arrow "c" in the drawing as well. Then, out of the sound proceeding in the direction shown by arrow "c", sound diffracted in a third diffraction opening 910*c* formed in the rear gap 910 between the tip of the rear fixed cover-tip side face facing projection 91*a* and the side face of the openable cover backwardly extended projection 35*c* proceeds in a direction as shown by arrow "d" in the drawing as well. In this way, by providing a structure, in which sound caused in the image forming apparatus 1 does not readily escape outside of the image forming apparatus 1 unless it undergoes diffraction multiple times in the rear gap 910, the sound can be effectively insulated.

Further, as shown in FIG. 17, the sheet feeding unit openable cover 35 also includes an openable cover tip projection 35*e* at a front side edge thereof, which also projects toward the inner side of the image forming apparatus 1. The front frame 92 of the sheet feeding unit fixed cover 9 includes a front fixed cover projection 92*a* that projects from an opening front end face 92*c* facing the side edge of the sheet feeding unit openable cover 35 on the front side thereof into the rear side and is bent to the right in FIG. 1. Hence, the openable cover tip projection 35*e* enters an interior of a recess formed by the opening front end face 92*c* and the front fixed cover projection 92*a* when the sheet feeding unit openable cover 35 is closed. Hence, the front gap 920 is formed by the opening front end face 92*c* and the front fixed cover projection 92*a* placed on opposite sides to collectively surround three sides of the tip of the openable cover tip projection 35*e* without contacting the openable cover tip projection 35*e*. Similar to the rear gap 910, since the front gap 920 also includes a labyrinth composed of multiple bending portions as well, the sound can be effectively insulated again.

Further, by similarly employing a labyrinth in each of the upper gap 930 and the bottom side gap 940, additionally, noise generated inside the image forming apparatus 1 can be more effectively suppressed even in a configuration having the multiple gaps between all of four sides of the sheet feeding unit openable cover 35 and the sheet feeding unit fixed cover 9.

FIG. 27 illustrates a related art, in which the rear gap 910 formed between the sheet feeding unit openable cover 35 and the sheet feeding unit fixed cover 9 includes the labyrinth and the sheet feeding unit openable cover 35 cannot be opened and closed thereby raising a problem. As described earlier, the sound generated in the image forming apparatus 1 travels to the outside of the image forming apparatus 1 from the gap formed between exterior covers, thereby possibly generating noise. In particular, an openable cover such as the sheet feeding unit openable cover 35, etc. is prone to cause a gap in a boundary neighboring to the other exterior cover. However, by employing the labyrinth in the gap as the boundary between the exterior covers, the noise therefrom can be effectively suppressed.

As also described earlier, out of side edges of the four sides of the openable cover acting as four boundaries located between the openable cover and the other exterior covers, three side edges located therebetween other than the side edge of the openable cover on the hinge side can relatively easily employ the labyrinths, respectively. However, when the openable cover is opened by swinging the tip of the openable cover toward the outside of the image forming apparatus 1 around the hinge, since the side edge of the openable cover on the hinge side is located on the opposite side to the tip of the openable cover across the hinge, the side edge of the openable cover on the hinge side enters the inside of the image forming apparatus 1. At this moment, however, since a portion of the side edge of the openable cover on the hinge side employs the labyrinth and interferences with a portion of the body, which also employs the labyrinth, the openable cover cannot be opened sometimes depending on a situation.

As shown in FIG. 27, in the related art, a sheet feeding unit openable cover 35 includes an openable cover inwardly extended projection 35*f* projecting toward an interior of the image forming apparatus 1 at the side edge of the sheet feeding unit openable cover 35 on the rear side thereof. A rear frame 91 of a sheet feeding unit fixed cover 9 includes a rear fixed cover bending projection 91*g* that projects from the opening rear end face 91*c* into the front side and is bent to the right in FIG. 1. The rear fixed cover bending projection 91*g* surrounds a tip of the openable cover inwardly extended projection 35*f*, thereby forming a labyrinth in the rear gap 910.

Hence, in the related art of FIG. 27, when the sheet feeding unit openable cover 35 is opened by swinging the sheet feeding unit openable cover 35 around the vertical hinge 35*a* toward the outside of the image forming apparatus 1 in a direction as shown by arrow F in FIG. 27, the openable cover inwardly extended projection 35*f* tends to enter the image forming apparatus 1 as shown by arrow F' in FIG. 27. However, in the configuration of the related art of FIG. 27, on a swinging locus of the openable cover inwardly extended projection 35*f* acting as the side edge of the sheet feeding unit openable cover 35 forming a labyrinth on the hinge side, the rear fixed cover bending projection 91*g* forming a labyrinth on the body side is located. This is because, the openable cover inwardly extended projection 35*f* projects from upstream to downstream in a direction of pivoting of the sheet feeding unit openable cover 35 (i.e., a direction shown by arrow F') when it is opened from a closed state to an opened state. For this reason, the openable cover inwardly extended projection 35*f* and the rear fixed cover bending projection 91*g* interfere with each there, so that the sheet feeding unit openable cover 35 cannot shift to a position of the open state as shown by a dashed line in FIG. 27.

To resolve such a problem, in the image forming apparatus 1 of this embodiment of the present disclosure, the openable cover backwardly extended projection 35*c* forming the labyrinth at the side edge of the sheet feeding unit openable cover 35 on the hinge side projects from the downstream to the upstream in the pivoting direction (i.e., arrow I in FIG. 17) of the sheet feeding unit openable cover 35 when it is opened.

Accordingly, when the sheet feeding unit openable cover 35 swings on the hinge 35*a* and is opened toward the outside of the image forming apparatus 1 in a direction as shown by arrow F in FIG. 17, the openable cover backwardly extended projection 35*c* accordingly swings in the direction as indicated by arrow I in FIG. 1 around the vertical hinge 35*a* as well.

With this, during the opening operation of the sheet feeding unit openable cover 35, since the openable cover backwardly extended projection 35*c* projects from the downstream to the upstream in the pivoting direction as shown arrow I as described earlier, a tip of the openable cover backwardly extended projection 35*c* almost moves toward the base of the openable cover backwardly extended projection 35*c*. That is, the openable cover backwardly extended projection 35*c* moves in a projecting direction of each of the rear cover tip opposing projection 91*a* and the rear cover side-face opposing projection 91*b*, both of which collectively form the labyrinth on the body side, and separates from these projections. For this reason, the sheet feeding unit openable cover 35 can pivot without interfering with the rear frame 91 of the sheet feeding unit fixed cover 9. Accordingly, the labyrinth can be as a practical matter formed in the rear gap 910 formed between the side edge of the sheet feeding unit openable cover 35 on the side of the vertical hinge 35*a* and the rear frame 91 of the sheet feeding unit fixed cover 9. Hence, while ensuring a gap (i.e., a rear gap 910) necessary for the sheet feeding unit openable cover 35 to swing, noise therefrom can be inhibited.

FIG. 20 is a cross-sectional view schematically illustrating the sheet feeding unit openable cover and the sheet feeding unit fixed cover along the line H-H drawn in FIG. 17 when the sheet feeding unit openable cover is closed according to the second embodiment of the present disclosure. The cross section along the line H-H shown in FIG. 17 is an imaginary plane perpendicular to a virtual vertical linear connection line (i.e., a linear line parallel to a coordinate axis Y) that connects the side edge of the sheet feeding unit openable cover 35 on the side of the vertical hinge 35*a* with the side edge of a tip side of the sheet feeding unit openable cover 35. In addition, in this embodiment of the present disclosure, a sheet feeding unit openable cover exterior surface 35*g* acting as the exterior surface of the sheet feeding unit openable cover 35 is parallel to a plane defined by coordinate axes Y-Z. Hence, the cross section along the line H-H in FIG. 17 provides a virtual plane (i.e., a plane defined by coordinate axes Z-X) parallel to the vertical hinge 35*a* and vertical to the sheet feeding unit openable cover exterior surface 35*g*.

Hence, in this embodiment of the present disclosure, as shown in FIGS. 17 and 20, in the cross section along the line H-H of the image forming apparatus 1, three projections (i.e., the openable cover backwardly extended projection 35*c*, the rear fixed cover-tip side face facing projection 91*a*, and the rear cover side-face opposing projection 91*b*) are positioned. That is, as shown in FIG. 20, in the cross section orthogonal to coordinate axis Y (i.e., a plane defined by coordinate axes X-Z), the openable cover backwardly extended projection 35*c*, and the rear cover tip opposing projection 91*a* and the rear cover side-face opposing projection 91*b*, collectively forming the recess while enclosing the openable cover backwardly extended projection 35*c*, are positioned. With this, the rear gap 910 is shaped into the labyrinth having multiple deflecting portions therein, so that sound escaping in a linear manner in a direction perpendicular to the sheet feeding unit openable cover exterior surface 35*g* (i.e., in a direction shown by the coordinate axis X) can be prevented.

As shown in FIG. 17, the tip side face and the left and right side faces of the openable cover backwardly extended projection 35*c* in FIG. 1 prepared in the sheet feeding unit openable cover 35 face a face of the rear frame 91 across the rear gap 910. A right side face of a rear cover side-face opposing projection 91*b* prepared in the rear frame 91 is opposed to (i.e., faces) a left side of the openable cover backwardly extended projection 35*c* of the sheet feeding unit openable cover 35 via the rear gap 910 in FIG. 17. A left side face of the rear cover tip opposing projection 91*a* prepared in the rear frame 91 is opposed to (i.e., faces) a right side of the openable cover backwardly extended projection 35*c* of the sheet feeding unit openable cover 35 via the rear gap 910 in FIG. 17. Further, a tip side face of the rear cover tip opposing projection 91*a* (prepared in the rear frame 91) is opposed to (i.e., faces) a rear face (i.e., an upper face in FIG. 1) of an openable cover inwardly extended portion 35*b* across the rear gap 910.

In this way, both in the sheet feeding unit openable cover 35 and the rear frame 91, the openable cover backwardly extended projection 35*c*, and a set of the rear fixed cover-tip side face facing projection 91*a* and the rear cover side-face opposing projection 91*b* are prepared, respectively, to collectively form the rear gap 910. Further, both tip side faces of the set of the rear fixed cover-tip side face facing projection 91*a* and the rear cover side-face opposing projection 91*b* projecting into the front side from the rear side of the image forming apparatus 1 are located close to a base of the openable cover backwardly extended projection 35*c* that projects from the front side into the rear side across a tip side face of the openable cover backwardly extended projection 35*c*. With this, a cross section of the tip side face of the openable cover backwardly extended projection 35*c* and the tip side faces of the rear cover tip opposing projections 91*a* and the rear cover side-face opposing projection 91*b* along the line H-H drawn between the tip side face of the openable cover backwardly extended projection 35*c* and the tip side face of the rear cover tip opposing projection 91*a* in a front to the rear side direction of the image forming apparatus 1 (i.e., in either a vertical direction or a direction of coordinate axis Y in FIG. 1) is represented as shown in FIG. 20. That is, three projections (i.e., the openable cover backwardly extended projection 35*c*, the rear cover tip opposing projection 91*a*, and the rear cover side-face opposing projection 91*b*) can be located within the cross section along the line H-H.

Further, the openable cover backwardly extended projection 35*c* projects into the rear side (i.e., an upper side direction in FIG. 17) from a position further inboard of the openable cover inwardly extended portion 35*b* of the sheet feeding unit openable cover 35 (i.e., on the left side in FIG. 1) than the vertical hinge 35*a* in the housing. Hence, when the sheet feeding unit openable cover 35 is opened, the position of an inner side of the openable cover inwardly extended portion 35*b* (a left side in FIG. 1) than the vertical hinge 35*a* in the housing firstly moves from the rear side to the front side (i.e., from a top to a bottom in FIG. 1) of the image forming apparatus 1. That is, when the sheet feeding unit openable cover 35 is opened, a tip of the openable cover backwardly extended projection 35*c* almost moves toward a base of the openable cover backwardly extended projection 35*c*. In other words, the openable cover backwardly extended projection 35*c* moves in a direction of projection of each of the rear cover tip opposing projection 91*a* and the rear cover side-face opposing projection 91*b*.

Now, an image forming apparatus 1 of a first modification (hereinafter simply referred to as a first modification) of the second embodiment of the present disclosure is described with reference to FIG. 21. FIG. 21 is a horizontal cross-sectional view schematically illustrating a sheet feeding unit openable cover 35 and a sheet feeding unit fixed cover 9 employed in the image forming apparatus 1 according to a first modification of the second embodiment of the present disclosure. The image forming apparatus 1 of the first modification shown in FIG. 21 omits the rear cover side-face opposing projection 91*b* included in the image forming apparatus 1 of the second embodiment of the present disclosure as shown in FIG. 1.

Hence, in a configuration of the first modification, out of sound proceeding in a direction as shown by arrow "a" in FIG. 21, sound diffracted (in a rear gap 910 at a first deflecting portion) proceeds in a direction as shown by arrow "b". Subsequently, out of the sound proceeding in the direction shown by arrow "b", sound diffracted (in the rear gap 910 at a second deflecting portion) proceeds in a direction as shown by arrow "c" and communicates with the outside of the housing. In this way, in the first modification of the second embodiment of the present disclosure, since the sound generated in the image forming apparatus 1 and heading to the outside of the image forming apparatus 1 undergoes diffraction twice in the rear gap 910, the sound can be effectively insulated.

Now, an image forming apparatus 1 of a second modification of the second embodiment of the present disclosure (hereinafter simply referred to as a second modification) is described with reference to FIGS. 22A and 22B. FIGS. 22A and 22B are diagrams collectively illustrating an exemplary sheet feeding unit openable cover 35 employed in the image forming apparatus 1 according to a second modification of the second embodiment of the present disclosure. In particular, FIG. 22A is a horizontal cross-sectional view schematically illustrating the sheet feeding unit openable cover 35 and the sheet feeding unit fixed cover 9 according to the second modification of the second embodiment of the present disclosure. FIG. 22B also is a cross-sectional view schematically illustrating the sheet feeding unit openable cover 35 and the sheet feeding unit fixed cover 9 of FIG. 22A, which is along the line J-J in FIG. 22A.

As shown in FIGS. 22A and 22B, in the second modification, an openable cover backwardly extended projection 35*c* projecting from a front side into a rear side of the image forming apparatus 1, a rear cover tip opposing projection 91*a* projecting from the rear side toward the front of the image forming apparatus 1, and a rear cover side-face opposing projection 91*b* also projecting from the rear side toward the front of the image forming apparatus 1 are provided. These three projections are positioned in a cross section along the line J-J shown in FIG. 8B again. Similar to the cross section along the line H-H shown in FIG. 1, the cross section along the line J-J of FIG. 22A is a virtual plane (i.e., a plane defined by coordinate axes Z-X) vertical to the sheet feeding unit openable cover exterior surface 35*g* and parallel with the vertical hinge 35*a*.

As shown in FIGS. 22A and 22B, in the image forming apparatus 1 of the second modification, both a rear fixed cover-tip side face facing projection 91*a* and a rear cover side-face opposing projection 91*b* are positioned on an inner side (i.e., on the left side in FIGS. 22A and 22B) of the openable cover backwardly extended projection 35*c* in the housing. The openable cover internally extended portion 35*b* includes an extended portion 35*b*1 extended from a position, at which the openable cover backwardly extended projection 35*c* is provided, toward the inner side of the housing (i.e., on the left side in FIGS. 22A and 22B. The extended portion 35*b*1 extends to reach a position to face a tip side face of the rear fixed cover tip side face facing projecting 91*a*, thereby forming a rear gap 910 between the extended portion 35*b*1 and the rear fixed cover tip side face facing projecting 91*a*. Further, a tip side face of the extended portion 35*b*1 on the inner side in the housing (i.e., on the left side in FIGS. 22A and 22B) faces a right side of the rear cover side-face opposing projection 91*b* in FIGS. 22A and 22B, thereby forming the rear gap 910 as well.

In short, in the image forming apparatus 1 of the second modification, the rear gap 910 is formed by the rear fixed cover-tip side face facing projection 91*a*, the rear cover side-face opposing projection 911), the extended portion 35*b*1, and the openable cover backwardly extended projection 35*c*, collectively. With this, the rear gap 910 is shaped into a labyrinth, so that sound generated in the image forming apparatus 1 and heading to the outside thereof in directions as shown by arrows "a", "b", "c", and "d" in FIG. 22A, respectively, undergoes diffraction multiple times. Hence, similar to the above-described configuration of the second embodiment of the present disclosure, the noise can be effectively suppressed while maintaining a prescribed sized of gap needed for the sheet feeding unit openable exterior cover 6 to smoothly pivot as well.

Now, an image forming apparatus 1 of a third modification of the second embodiment of the present disclosure (hereinafter simply referred to as a third modification) is described with reference to FIGS. 23 and 24. FIG. 23 is a diagram schematically illustrating an exemplary sheet feeding unit openable cover 35 and a sheet feeding unit fixed cover 9 according to a third modification of the second embodiment of the present disclosure. FIG. 24 is a diagram schematically illustrating an exemplary rear gap 910 formed between the sheet feeding unit openable cover 35 and the sheet feeding unit fixed cover 9 (of a rear side) according to a third modification of the second embodiment of the present disclosure.

As shown in FIG. 23, in the third modification, an openable cover separate member 36 is attached to an inner side of the sheet feeding unit openable cover 35 as an annex. An openable annexing cover backwardly extended projection 36*a* is provided in the openable cover separate member 36 to backwardly project from the openable cover separate member 36 toward the rear side of the image forming apparatus 1. As shown there, the openable annexing cover backwardly extended projection 36*a*, the openable cover inwardly extended portion 35*b*, and the openable cover backwardly extended projection 35*c* are opposed to (i.e., face) and collectively surround three sides of the tip of the rear cover tip opposing projection 91*a*. Hence, a rear gap 910 is formed between these portion and projections 35*b*, 35*c*, and 36*a*.

That is, as shown in FIG. 23, in the configuration of the third modification, the openable annexing cover backwardly extended projection 36*a* that projects from a front side to a rear side of the image forming apparatus 1, the openable cover backwardly extended projection 35*c*, and the rear cover tip opposing projection 91*a* projecting from the rear side to the front side of the image forming apparatus 1 are provided. These three projections 36*a*, 35*c*, and 91*a* are positioned within a cross section along the line K-K drawn in FIG. 9. Similar to the cross section along the line shown in FIG. 1, the cross section along the line K-K shown in FIG. 23 is a virtual plane (i.e., a plane defined by coordinate axes Z-X) vertical to the sheet feeding unit openable cover exterior surface 35*g* and parallel with the vertical hinge 35*a*.

In this way, in the image forming apparatus 1 of the third modification, the rear gap 910 is formed by the openable annexing cover backwardly extended projection 36*a*, the openable cover backwardly extended projection 35*c*, the openable cover inwardly extended portion 35*b*, and the rear cover tip opposing projection 91*a*, collectively. Accordingly, the rear gap 910 is shaped into a labyrinth again, in which sound generated in the image forming apparatus 1 and heading to the outside thereof in directions as shown by arrows "a"-"e" in FIG. 9, respectively, undergoes diffraction multiple times. Hence, similar to the above-described configuration of the second embodiment of the present disclosure, the noise can be effectively suppressed while maintaining the prescribed sized of gap needed for the sheet feeding unit openable exterior cover 6 to smoothly pivot as well.

Further, in the third modification of the second embodiment of the present disclosure, as the openable covers pivoting around the vertical hinge 35*a*, two members (i.e., the sheet feeding unit openable cover 35 and the openable the other cover) are employed. The sheet feeding unit openable cover 35 and the openable cover separate member 36 include the openable cover backwardly extended projection 35*c* and the openable annexing cover backwardly extended projection 36*a* as projections projecting from these openable covers, respectively. With these two openable cover projections projecting from the two separate members, a recess can be easily formed and surrounds the tip of the rear fixed cover tip side face facing projecting 91*a*.

Further, as shown in FIG. 23, in the rear frame 91 of the image forming apparatus 1 of this third modification, a rear frame slope 91*f* sloped to a rear frame exterior surface 91*d* of the in the rear frame 91 is provided at a front side edge of the rear frame 91. With the rear frame slope 91*f* provided in this way, the sheet feeding unit openable cover 35 can pivot widely more than angle of 90 degrees without causing interference between a rear side edge of the sheet feeding unit openable cover 35 and the rear frame 91 with each other. With this, maintenance of inner parts and visibility of the interior of the housing each needed when the sheet feeding unit openable cover 35 is opened can be upgraded.

That is, as a pivotable angle of the sheet feeding unit openable cover 35 increases, the gap between the side edge of the sheet feeding unit openable cover 35 on the hinge side and the rear frame 91 becomes wider, thereby enhancing provability of noise. To solve such a problem, in the third modification of the (second embodiment of the) present disclosure, with the rear frame slope 91*f*, the exterior cover is tapered at the rear gap 910 such that the rear gap 910 gradually narrows as it goes the inner side (i.e., on the left side of FIG. 9) of the at the rear gap 910. With this, while narrowing the gap between the side edge of the sheet feeding unit openable cover 35 on the hinge side and the rear frame 91 at a position, at which the side edge of the sheet feeding unit openable cover 35 on the hinge side is closest to the rear frame 91, the sheet feeding unit openable cover 35 can increasingly widely pivot by angle of 90 degrees or more. Consequently, while widening the pivotable angle of the sheet feeding unit openable cover 35, a function to suppress noise can be maintained at the same time.

Now, an image forming apparatus 1 of a fourth modification of the second embodiment of the present disclosure (hereinafter simply referred to as a fourth modification) is described with reference to FIGS. 25A and 25B. FIGS. 25A and 25B are diagrams collectively illustrating an exemplary sheet feeding unit openable cover employed in the image forming apparatus 1 according to a fourth modification of the second embodiment of the present disclosure. In particular, FIG. 25A is a horizontal cross-sectional view schematically illustrating a sheet feeding unit openable cover 35 and a sheet feeding unit fixed cover 9 according to the fourth modification of the second embodiment of the present disclosure. FIG. 25B is also a cross-sectional view along the line shown in FIG. 25A according to the fourth modification of the second embodiment of the present disclosure.

As shown in FIGS. 25A and 25B, in an image forming apparatus of the fourth modification, the sheet feeding unit openable cover 35 includes a single openable cover backwardly extended projection 35*c* that projects from the front side toward to the rear side of the image forming apparatus 1. Further, the sheet feeding unit fixed cover 9 includes a pair of rear cover tip opposing projections 91*a* that project from the sheet feeding unit fixed cover 9 in the direction from the rear side to the front side of the image forming apparatus 1, respectively. In the fourth modification, the rear fixed cover further includes a rear cover side-face opposing projection 91*b* that projects from the rear fixed cover in a direction from the rear side to the front side of the image forming apparatus 1. These four projections 35*c*, 91*a*, 91*a*, and 91*b* are positioned within a cross section along the line on L-L shown in FIG. 25B. Similar to the cross section along the line H-H shown in FIG. 17, the cross section along the line L-L shown in FIG. 11A is a virtual plane (i.e., a plane defined by coordinate axes Z-X) vertical to the sheet feeding unit openable cover exterior surface 35*g* and parallel with the vertical hinge 35*a*.

Further, as shown in FIGS. 25A and 25B, the pair of rear cover tip opposing projections 91*a* and the rear cover side-face opposing projection 91*b* are positioned on an inner side (i.e., on the left side in FIG. 11A) of the openable cover backwardly extended projection 35*c* in the housing. Further, in the image forming apparatus 1 of the fourth modification, the openable cover inwardly extended portion 35*b* includes an extended portion 35*b*1 extended on an inner side (i.e., on the left in FIG. 25A) of a position, at which the openable cover backwardly extended projection 35*c* is formed, in the housing. Specifically, the extended portion 35*b*1 is formed to reach a position to face respective tip side faces of the pair of rear cover tip opposing projections 91*a*, thereby forming a rear gap 910 between the extended portion 35*b*1 and the pair of rear cover tip opposing projections 91*a*. At the same time, a tip side face of the extended portion 35*b*1 on an inner side (i.e., on the left in FIG. 25A) of the housing faces a right side face of the rear cover side-face opposing projection 91*b* in FIG. 23A, thereby forming the rear gap 910 again.

In short, in the image forming apparatus 1 of the fourth modification, the rear gap 910 is formed by the pair of rear cover tip opposing projections 91*a*, the rear cover side-face opposing projection 91*b*, the extended portion 35*b*1, and the openable cover backwardly extended projection 35*c*, collectively. Accordingly, the rear gap 910 is again shaped into a labyrinth, in which sound generated in the image forming apparatus 1 and heading to the outside thereof in directions shown by arrows "a", "b", "c", and "b" in FIG. 25A, respectively, undergoes diffraction multiple times. In this way, similar to the above-described configuration of the embodiment of the present disclosure, while maintaining a prescribed size of gap needed for the sheet feeding unit openable cover 35 to smoothly swing, noise therefrom can be inhibit as well.

As also shown in FIGS. 25A and 25B, in the fourth modification of the second embodiment of the present disclosure, as one or more connectors to connect the pair of rear cover tip opposing projections 91*a* to each other, one or more rear fixed cover projection reinforcing ribs 91*e* are provided therebetween. That is, multiple rear fixed cover projection of ribs 91*e* are disposed in multiple sections in FIG. 25A, respectively, in a direction perpendicular to a plane of FIG. 25A (i.e., in a direction shown by coordinate axis Z or a vertical direction in FIG. 25B). Hence, strength and sound shielding performance can be upgraded while preferably determining the width of the rear gap 910 as well.

Now, an image forming apparatus 1 of a fifth modification of the second embodiment of the present disclosure (hereinafter simply referred to as a fifth modification) described with reference to FIG. 26. FIG. 26 is a horizontal cross-sectional view schematically illustrating a sheet feeding unit openable cover and a sheet feeding unit fixed cover according to a fifth modification of the second embodiment of the present disclosure.

As shown in FIG. 26, an image forming apparatus 1 of the fifth modification includes a sheet feeding unit inner cover 80 as an interior member covered by the sheet feeding unit openable cover 35 when the sheet feeding unit openable cover 35 is closed, and is exposed when the sheet feeding unit openable cover 35 is opened up. The sheet feeding unit inner cover 80 is independently attached from the sheet feeding unit fixed cover 9 acting as the exterior cover having the rear frame 91. The sheet feeding unit inner cover 80 includes an inner cover projection 80*a* projecting from the sheet feeding unit inner cover 80 in a direction from the rear side to the front side of the image forming apparatus 1. Hence, a rear gap 910 is collectively formed by the inner cover projection 80*a*, the opening rear end face 91*c*, and the rear cover tip opposing projection 91*a* opposed to (i.e., facing) and surrounding three sides of the openable cover backwardly extended projection 35*c*.

Hence, as shown in FIG. 26, the image forming apparatus 1 of the fifth modification includes the single openable cover backwardly extended projection 35*c* projecting from a portion of the sheet feeding unit openable cover 35 in the direction from the front side toward the rear side, the rear cover tip opposing projection 91*a* projecting from the rear frame 91 (or the sheet feeding unit fixed cover 9) in the direction from the rear side to the front side of the image forming apparatus 1, and the inner cover projection 80*a*. These three projections 91*a*, 35*c*, and 80*a* are positioned within a cross section along the line M-M shown in FIG. 26. Similar to the cross section along the line H-H shown in FIG. 17, the cross section along the line M-M shown in FIG. 12 is a virtual plane (i.e., a plane defined by coordinate axes Z-X) vertical to the sheet feeding unit openable cover exterior surface 35*g* and parallel with the vertical hinge 35*a*.

Specifically, in the image forming apparatus 1 of the fifth modification, the rear gap 910 is collectively formed by the inner cover projection 80*a*, the openable cover backwardly extended projection 35*c*, the opening rear end face 91*c*, and the rear fixed cover-tip side face facing projection 91*a*. In short, the rear gap 910 is shaped into a labyrinth again, in which sound generated in the image forming apparatus 1 and heading to the outside thereof in directions shown by arrows "a", "b", "c", and "b" in FIG. 12, respectively, undergoes diffraction multiple times. Hence, similar to the above-described configuration of the embodiment of the present disclosure, the noise can be effectively suppressed while maintaining the prescribed size of gap needed for the sheet feeding unit openable exterior cover 6 to smoothly pivot as well.

Here, the sheet feeding unit inner cover 80 of the fifth modification is fixed to a frame of the body of the image forming apparatus 1 together with the sheet feeding unit fixed cover 9, thereby constituting a portion of the adjacent cover. That is, in the fifth modification, the sheet feeding unit inner cover 80 and the sheet feeding unit fixed cover 9 constituting the adjacent covers respectively include the inner cover projection 80*a* and the rear fixed cover-tip side face facing projection 91*a* constituting adjacent cover projections, respectively. With these two adjacent cover projections projecting from separate members, respectively, a recess can be easily formed to surround the tip of the openable cover backwardly extended projection 35*c*.

In the above-described embodiments and modifications, the horizontally openable sheet feeding unit cover 35 opened and closed around the vertical hinge 35*a* extended vertically is typically described. However, the labyrinth employed in the above-described embodiments and modifications can be similarly employed in each of the above-described rear gap 910, the front gap 920, the upper gap 930, and the bottom side gap 940 even in a housing in which a vertically openable exterior cover 6 is employed and is opened and closed around a horizontally extended hinge 6*a* as shown in FIG. 3.

As described heretofore in the various embodiments and modifications, to deflect the sound (i.e., air flow) multiple times, since the above-described rear gap 910 formed in the image forming apparatus 1 includes the multiple bending portions established by bending an air flow path that linearly connects the interior with the exterior across the exterior cover at several locations, and the sound is subjected to diffraction (i.e., deflected) multiple times there, the sound can be damped and can be effectively suppressed as well.

In this way, in the above-described various embodiments and modifications, the deflecting portions having multiple bending portions to divert the air flow (or deflect the sound) are prepared by bending a (flat) cover at a right angle. However, the present disclosure is not limited to the multiple bending portions prepared by bending the flat cover at the right angle, and includes one or more gradually curved paths as well.

Further, in the above-described various embodiments and modifications, the labyrinth of the rear gap 910 is formed between the sheet feeding unit openable cover 35 acting as the openable cover and either the sheet feeding unit fixed cover 9 acting as the fixed exterior cover or the inner cover. However, the present disclosure is not limited to the exterior cover and the inner cover as members to form the rear gap 910 shaped into the labyrinth, and includes a portion of a body frame of the image forming apparatus 1. That is, the portion of a body frame of the image forming apparatus 1 can form the rear gap 910 as well. In such a situation, the body frame acts as the adjacent cover, accordingly.

Further, the openable cover creating the gap on the hinge side is not limited to the exterior cover of the image forming apparatus 1, such as the sheet feeding unit openable cover 35, etc. That is, the openable cover creating the gap on the hinge side may be a member exposed when the exterior cover (e.g., the sheet unit rear fixed cover) is removed, a member exposed when the openable exterior cover is opened, and a member opened and closed by an interior cover (or an inner cover) as well. Further, the openable cover creating the gap on the hinge side is not limited to the exterior cover and the interior cover of the image forming apparatus, and can include a cover of an inner housing installed in the image forming apparatus to accommodate inner devices, such as an optical scanning unit 41, a drive unit etc., as well.

Heretofore, the various embodiments and modifications are described in a situation in which the housing with the openable cover is that of the image forming apparatus. However, the present disclosure is not limited thereto and can be applied to various electronic devices other than the image forming apparatus as well as long as the electronic device includes a sound generating source generating sound during its operation and an openable cover that partitions a space into an interior, in which sound generating source is arranged, and an exterior thereof. Further, the labyrinth as employed in the various embodiments and modifications to constitute the gap of the openable cover on the hinge side can be applied to not only the electronic devices, but also any housing required to suppress the noise from the inside to the outside thereof as well.

The above-described embodiments and modifications of the present disclosure are just examples and have the following detailed advantages, per embodiment or modification.

According to one aspect of the present disclosure, according to one aspect of the present disclosure, a housing, such as the image forming apparatus body 11, includes multiple covers (e.g., the right side surface upper cover 2, the right side surface bottom cover 7, and the openable exterior cover 6) to separate the interior of the housing from the exterior of the housing. The multiple covers include an openable cover (e.g., the openable exterior cover 6) to pivot on the hinge, such as the hinge 6*a*, to separate the interior of the housing from the exterior of the housing. The openable cover includes a first side edge on a side of the hinge. An adjacent cover, such as the right side surface bottom cover 7, is also provided to separate the interior of the housing from the exterior of the housing. The adjacent cover includes a second side edge neighboring the first side edge of the openable exterior cover across a gap (e.g., the supported side gap 17). One of the openable cover and the adjacent cover includes a projection, such as the openable cover supported end projection 6*b*. The other one of the openable cover and the adjacent cover includes a recess (e.g., a recess formed between an opening section bottom face 7*c* and a face of a bottom cover projection 7*a*) that accommodates the tip of the projection. For such a configuration, a gap is formed between a tip of a projection and a recess, the gap accordingly includes several deflects having multiple bending portions at several locations. Accordingly, sound generated in a housing and heading to an exterior of the housing via the several deflects having multiple bending portions undergoes diffraction multiple times therein. Since the sound is reduced when undergoing the diffraction multiple times, noise from the gap can be effectively suppressed even when the gap is formed in an image forming apparatus. Hence, in a first aspect of the present disclosure, the noise can be effectively suppressed even in the housing having an openable cover. A deflecting section is employed in an air passage (i.e., a sound transmission route) rather than a linear connecting path, and is composed of either one or more bends or curves to deflect and convey sound outside. Although the air passage is bent at a right angle multiple times in the above-described various embodiments of the present disclosure, the air passage can be curved multiple times to change a direction of the air passage.

According to another aspect of the present disclosure, the hinge, such as the hinge 6*a*, is located inside the recess (e.g., the recess formed between the opening section bottom face 7*c* and the face of the bottom cover projection 7*a*). With such a configuration, a pivoting radius of a projection, such as the openable cover supported end projection 6*b*, can be reduced. Hence, the projection can pivot inside the recess without interfering with a member, such as the right side surface bottom cover 7, forming the recess. Accordingly, while shaping the gap, such as the supported side gap 17, to have the deflecting section having multiple bending portions at multiple locations, the openable cover such as an openable exterior cover 6, can be pivoted.

According to yet another aspect of the present disclosure, one of the adjacent covers is an external cover (e.g., the right side surface bottom cover 7) to separate the interior of the housing from the exterior of the housing. With such a configuration, as described above, noise from a housing with the openable cover (e.g., the openable exterior cover 6) can be effectively suppressed.

According to yet another aspect of the present disclosure, the at least one adjacent cover is an inner cover, such as the inner cover 8, covered by the openable cover, such as the openable exterior cover 6, when the openable cover is closed. With such a configuration, as described about, e.g., the above-described third modification of the first embodiment of the present disclosure, noise from the housing with the openable cover, such as the openable cover 6, can be more effectively suppressed.

According to yet another aspect of the present disclosure, the projection, such as the openable cover supported end projection 6*b*, and the recess (e.g., the recess formed between the opening section bottom face 7*c* of the right side surface bottom cover 7 and the bottom cover projection 7*a*, etc.) are positioned on a single virtual plane (e.g., a cross section along the line B-B) parallel to a surface of the openable cover, such as the openable exterior cover 6. The deflecting section having multiple bending portions can be formed within the gap, such as the supported side gap 17, at several locations, respectively.

According to yet another aspect of the present disclosure, the number of the at least one projection (e.g., the openable cover supported end projection 6*b*) surrounded by the recess (e.g., the recess formed between the opening section bottom face 7*c* and the bottom cover projection 7*a*, etc.) is two or more. As described with e.g., the first modification of the first embodiment, a gap, such as a supported side gap 17, formed between the projection and the recess can be adjust without thickening the projection.

According to yet another aspect of the present disclosure, the plurality of projections (e.g., the openable cover supported end projection 6*b*) have different projecting lengths from each other. As described with e.g., the first modification of the first embodiment, the projecting length of each of the projections projecting from the hinge (e.g., the hinge 6*a*) can be adjusted not to interfere with the member that forms the recess when each of the projections swings.

According to yet another aspect of the present disclosure, at least one projection connector, such as a projection reinforcing rib 6*e*, is provided to connect the at least two projections, such as the openable cover supported end projections 6*b*, to each other. As described with e.g., the first modification of the first embodiment, the strength of the openable cover, such as the openable exterior cover 6, and sound shielding performance by means of the openable cover can be enhanced.

According to yet another aspect of the present disclosure, a housing, such as, such as the image forming apparatus body 11 of an image forming apparatus 1, includes multiple covers (e.g., the right side surface upper cover 2, the right side surface bottom cover 7, and the openable exterior cover 6) to separate an interior of the housing from an exterior of the housing. The multiple covers include an openable cover (e.g., the openable exterior cover 6) provided to swing on a hinge, such as the hinge 6*a*, to separate the interior of the housing from the exterior of the housing. The openable cover includes a first side edge on a side of the hinge. An adjacent cover (e.g., the right side surface upper cover 2 or the right side surface bottom cover 7) is also provided to separate the interior of the housing from the exterior of the housing. The adjacent cover includes a second side edge neighboring the first side edge of the openable cover across a gap, such as the supported side gap 17. An air passage extends from the interior of the housing to the exterior of the housing through the gap. The air passage includes two or more deflecting portions (to deflect sound generated in the housing). With such a configuration, as described above, since sound generated in a housing and heading to an outside of the housing through a gap, in which a deflecting section having multiple bending portions is formed, undergoes diffraction in the gap multiple times, and is accordingly reduced, noise from the gap can be effectively suppressed even in a system having the gap intentionally employed. That is, noise can be effectively suppressed in the housing with the openable cover.

According to yet another aspect, a pivotable angle of the openable cover (e.g., the openable exterior cover 6) is about 90 degrees or more. With such a configuration, as described with, e.g., the first modification of the first embodiment of the present disclosure, the openability of the openable cover, maintenability of internal devices, and visibility of the internal devices can be enhanced.

According to yet another aspect of the present disclosure, the gap (e.g., the supported side gap 17) inwardly increasingly narrows to form a taper near an exterior surface of the housing. With such a configuration, as described with, e.g., the first modification of the first embodiment), the function to suppress the noise can be maintained while increasing the degree of pivotable angle of the openable cover.

According to yet another aspect of the present disclosure, multiple projections are formed on three side edges of the openable cover, such as the openable exterior cover 6, other than a side edge thereof on a supported end side, respectively. Correspondingly, both the adjacent covers, such as the right side surface upper cover 2 and the right side surface bottom cover 7, which form the non-rotary axis side gaps, respectively, include recesses to almost surround tips of the projections formed on the three side edges of the openable cover. With this, the gaps in the entire circumferential side edges of the openable cover can include deflects each having a deflecting section composed of several deflecting portions, and noise generated inside the image forming apparatus or the like and heading to the outside can be effectively suppressed. That is, according to yet another aspect of the present disclosure, an air passage extends from an interior of the housing to an exterior of the housing. The one openable cover (e.g., the openable exterior cover 6) includes a third side edge different from the first side edge on a side other than the side of the hinge, such as the hinge 6*a*. The adjacent cover (e.g., either the right side surface upper cover 2 or the tight side surface bottom cover 7) includes a fourth side edge different from the second side edge. The fourth side edge neighbors the third side edge of the openable cover across a gap (e.g., either the tip side gap 12 or the side edge gap 18). The gap constitutes a part of the air passage. The air passage includes two or more deflecting portions (to deflect sound generated in the housing). With such a configuration, as described with, i.e., the above-described embodiment of the present disclosure, since a non-rotary axis side gap is additionally formed, the openable cover can prevent interference with the adjacent cover when the openable cover is either opened or closed. Further, since sound generated in the image forming apparatus, such as the image forming apparatus 1, and heading to the outside of the image forming apparatus via the non-rotary axis side gap, in which a deflecting section having multiple bending portions is formed, undergoes diffraction multiple times in the non-rotary axis side gap thereby becoming smaller, the sound can rarely escape out through the non-rotary axis side gap.

According to yet another aspect of the present disclosure, the hinge (e.g., the vertical hinge 35*a*) of the openable cover, such as the sheet feeding unit openable cover 35, extends vertically to open and close the openable cover laterally (i.e., horizontally). With such a configuration, as described above, noise from a horizontally openable cover can be effectively suppressed.

According to yet another aspect of the present disclosure, the hinge, such as the hinge 6*a*, of the openable cover (e.g., the openable exterior cover 6) extends horizontally to open and close the openable cover vertically. With such a configuration, as described above, noise from a vertically openable cover can be effectively suppressed.

According to yet another aspect of the present disclosure, an electronic device, such the image forming apparatus 1, includes a sound source, such as the drive motor or the optical scanning unit 41, to generate sound during operation of the sound source, and the above-described housing to cover the sound source. With such a configuration, as described above, operation noise generated by an electronic device with an openable cover, such as an openable exterior cover 6, can be effectively suppressed to escape outside the electronic device.

According to yet another aspect of the present disclosure, an image forming apparatus, such the image forming apparatus 1, having the openable cover, such as the openable exterior cover 6, includes the above-described electronic device. With such a configuration, as described above, operation noise generated by the image forming apparatus with the openable cover, such as the openable exterior cover 6, can be effectively suppressed to escape outside the image forming apparatus.

According to yet another aspect of the present disclosure, a housing includes two or more covers each to separate an interior of the housing from an exterior of the housing. The two or more covers include an openable cover (e.g., the sheet feeding unit openable cover 35) to swing on a hinge (e.g., the vertical hinge 35*a*) to separate the interior of the housing from the exterior of the housing. The openable cover includes a first side edge on a side of the hinge. An adjacent cover (e.g., the sheet feeding unit fixed cover 9) is also provided to separate the interior of the housing from the exterior of the housing. The adjacent cover includes a second side edge neighboring the first side edge of the openable cover across a gap (e.g., the rear gap 910). An openable cover projection (e.g., the openable cover backwardly extended projection 35*c*) is also provided to project from the openable cover into the adjacent cover in the gap. An air passage extends from the interior of the housing to the exterior of the housing through the gap. The openable cover projection forms a deflecting section having multiple bending portions in the gap. The openable cover swings from a closed state to an opened state. The openable cover projection separates in a direction away from the adjacent cover. With such a configuration, as described above, since the openable cover projection forming the deflecting section separates from the adjacent cover when the openable cover is opened and closed, the openable cover can be opened and closed without interfering with the adjacent cover. Further, the air passage can be bent multiple times at a right angle or curved to change its orientation. Further, since the deflecting section is composed of either one or more bending portions or one or more curved portions disposed on an air passage to transmit sound, the air passage becomes roundabout more than a linear line path linearly transmitting sound to the outside.

According to yet another aspect of the present disclosure, a housing includes two or more covers each to separate an interior of the housing from an exterior of the housing. The covers include an openable cover (e.g., the sheet feeding unit openable cover 35) to swing on a hinge (e.g., the vertical hinge 35*a*) to separate the interior of the housing from the exterior of the housing. The openable cover includes a first side edge on a side of the hinge (e.g., the vertical hinge 35*a*). An adjacent cover (e.g., the sheet feeding unit fixed cover 9) is also provided to separate the interior of the housing from the exterior of the housing. The adjacent cover includes a second side edge neighboring the first side edge of the openable cover across a gap (e.g., the rear gap 910). An openable cover projection (e.g., the openable cover backwardly extended projection 35*c*) is provided to project from a position further inboard (e.g., the openable cover inwardly extended portion 35*b*) of the housing than the hinge into the adjacent cover to form the gap between a tip side face of the openable cover projection and the adjacent cover. An adjacent cover tip side face facing projection (e.g., the rear cover tip opposing projection 91*a*) is also provided to project from the adjacent cover in an opposite direction to that of the openable cover projection with a tip side face of the adjacent cover tip side face facing projection located close to a base of the openable cover projection across a tip of the openable cover projection to form the gap between the tip side face of the adjacent cover tip side face facing projection and the openable cover. With such a configuration, as described above, the tip side face of the openable cover projection and the tip side face of the adjacent cover tip side face facing projection collectively form the gap. The air passage extends from the inside of the housing to the outside of housing through the gap. The air flow firstly reaches a path facing one of the tip side faces of the openable cover projection and the adjacent cover tip side face facing projection. The air flow after that reaches a path formed between a side face of the openable cover and a side face of the adjacent cover tip side face facing projection. The air flow subsequently reaches a path facing the other one of the tip side faces of the openable cover projection and the adjacent cover tip side face facing projection. The air passage accordingly constitutes a deflecting section including two or more deflecting portions therein. One of the deflecting portions is an interval between a path facing one of the tip side faces and a path sandwiched between the both side faces. The other one of deflecting sections is an interval between a path sandwiched between the both side faces and a path facing the other one of the tip side faces. Accordingly, sound generated in the housing and heading to the exterior of the housing via the deflecting section having multiple bending portions undergoes diffraction therein multiple times. Since the sound is reduced when undergoing the diffraction multiple times in this way, noise from the gap can be effectively suppressed even when the gap is formed in a system (e.g., the image forming apparatus 1).

According to yet another aspect of the present disclosure, the adjacent cover projection (e.g., the rear cover tip opposing projection 91*a*) projects into the openable cover (e.g., the sheet feeding unit openable cover 35) from the adjacent cover (e.g., the sheet feeding unit fixed cover 9). The tip side face of the adjacent cover projection is located close to the base of the openable cover projection (e.g., the openable cover backwardly extended projection 35*c*) across the tip side face of the openable cover projection. With such a configuration, as described above, the gap, such as the rear gap 910, formed between the adjacent cover projection and the openable cover projection can provide a deflecting section composed of multiple bending portions in the air passage.

According to yet another aspect (e.g., the fifth modification of the second embodiment) of the present disclosure, two or more adjacent covers (e.g., the sheet feeding unit inner cover 80 and the sheet feeding unit fixed cover 9) include two or more adjacent cover projections (e.g., the inner cover projection 80*a* and the rear cover tip opposing projection) 91*a*), respectively. Such a configuration can easily obtain multiple adjacent cover projections by forming the multiple adjacent cover projections on the separate members, respectively.

According to yet another aspect of the present disclosure, each of the openable covers (e.g., the sheet feeding unit openable cover 35 and the openable cover separate member 36) includes the openable cover projection (e.g., the openable cover backwardly extended projection 35*c* and the separate cover backwardly extended projection 36*a*). With such a configuration, as described above, one or more projections can be easily prepared by using separate members, respectively.

Numerous additional modifications and variants of the present disclosure are possible in light of the above teachings. It is therefore to be understood that within the scope of the appended claims, the present disclosure may be practiced otherwise than as specifically described herein. For example, the housing is not limited to the above-described various embodiments and modifications may be made as appropriate. Further, the electronic device is not limited to the above-described various embodiments and modifications may be altered as appropriate as well. Furthermore, the image forming apparatus is not limited to the above-described various embodiments and modifications may be altered as appropriate as well.

What is claimed is:

1. A housing comprising:

at least one openable cover to swing on a hinge to separate an interior of the housing from an exterior of the housing, the at least one openable cover having a first side edge on a side of the hinge; and an adjacent fixed cover adjacent to the at least one openable cover, the adjacent fixed cover having a second side edge neighboring the first side edge of the at least one openable cover, one of the at least one openable cover and the adjacent fixed cover including at least one projection projecting into a gap and another one of the at least one openable cover and the adjacent fixed cover including a recess that accommodates the at least one projection in the gap, and a tip of the at least one projection swings inside the recess with a swing of the at least one openable cover.

2. The housing according to claim 1, wherein the hinge is located inside the recess.

3. The housing according to claim 1, wherein one of the at least one adjacent cover is an external cover to separate the interior of the housing from the exterior of the housing.

4. The housing according to claim 1, wherein the adjacent fixed cover is covered by the at least one openable cover when the at least one openable cover is closed.

5. The housing according to claim 1, wherein the projection and the recess are positioned on a single virtual plane parallel to a surface of the openable cover.

6. The housing according to claim 1, comprising at least two projections.

7. An electronic device, comprising:

a sound source that generates sound during operation of the electronic device; and the housing according to claim 1 to cover the sound source.

8. An image forming apparatus comprising the electronic device according to claim 7.

9. The housing according to claim 1, wherein the recess is formed by an upper edge, a side edge and a bottom edge of the adjacent fixed cover.

10. The housing according to claim 1, wherein the projection is surrounded on three sides by portions of the adjacent fixed cover.

11. A housing comprising:

a plurality of covers to separate an interior of the housing from an exterior of the housing, the plurality of covers including at least one openable cover with a shaft to swing on the shaft and at least one adjacent cover adjacent to the at least one openable cover;

one of the at least one openable cover and the at least one adjacent cover including a projection; and another of the at least one openable cover and the at least one adjacent cover including a recess that surrounds a projecting end of the projection, the projecting end of the projection to swing inside the recess with a swing of the at least one openable cover, and a gap being between the projecting end of the projection and an inner surface of the recess in a state in which the at least one openable cover is closed.

12. The housing according to claim 11, wherein the shaft is located inside the recess.

13. The housing according to claim 11, wherein one of the at least one adjacent cover is an external cover to separate the interior of the housing from the exterior of the housing.

14. The housing according to claim 11, wherein the at least one adjacent cover is covered by the at least one openable cover when the at least one openable cover is closed.

15. The housing according to claim 11, wherein the projection and the recess are positioned on a single virtual plane parallel to a surface of the openable cover.

16. An electronic device, comprising:

a sound source that generates sound during operation of the electronic device; and the housing according to claim 11 to cover the sound source.

17. An image forming apparatus comprising the electronic device according to claim 16.

18. The housing according to claim 11, wherein the projection is disposed at the at least one openable cover.

19. The housing according to claim 11, wherein the projection is disposed at the at least one adjacent cover.

* * * * *